US008344235B2

(12) United States Patent
Steele

(10) Patent No.: US 8,344,235 B2
(45) **Date of Patent: *Jan. 1, 2013**

(54) ELECTRONIC HIGH-HAT CIRCUITRY SYSTEM

(76) Inventor: Mark David Steele, New Smyrna Beach, FL (US)

( * ) Notice: Subject to any disclaimer, the term of this patent is extended or adjusted under 35 U.S.C. 154(b) by 68 days.

This patent is subject to a terminal disclaimer.

(21) Appl. No.: 12/946,385

(22) Filed: Nov. 15, 2010

(65) Prior Publication Data

US 2011/0056361 A1 Mar. 10, 2011

Related U.S. Application Data

(63) Continuation-in-part of application No. 12/321,243, filed on Jan. 20, 2009, now Pat. No. 7,838,753.

(51) Int. Cl.
*G10H 1/00* (2006.01)

(52) U.S. Cl. ..... 84/615; 84/622; 84/653; 84/659; 84/422.3

(58) Field of Classification Search ..... 84/615, 84/622, 653, 659, 402, 422.3
See application file for complete search history.

(56) References Cited

U.S. PATENT DOCUMENTS

| | | | | |
|---|---|---|---|---|
| 5,262,585 | A * | 11/1993 | Greene et al. | 84/645 |
| 5,267,500 | A * | 12/1993 | Lombardi | 84/402 |
| 5,438,903 | A | 8/1995 | Cropek | |
| 6,822,148 | B2 * | 11/2004 | Yanase | 84/422.1 |
| 7,351,902 | B1 * | 4/2008 | Sikra | 84/422.1 |
| 7,473,834 | B2 * | 1/2009 | Yoshino | 84/402 |
| 7,589,275 | B2 * | 9/2009 | Arimoto | 84/723 |
| 7,838,753 | B2 * | 11/2010 | Steele | 84/422.1 |
| 7,943,841 | B2 * | 5/2011 | Toda | 84/422.3 |
| 2002/0112593 | A1 * | 8/2002 | Yanase | 84/411 P |
| 2005/0145101 | A1 * | 7/2005 | Yoshino | 84/723 |
| 2005/0145102 | A1 * | 7/2005 | Susami | 84/735 |
| 2005/0150349 | A1 * | 7/2005 | Susami | 84/299 |
| 2005/0150355 | A1 * | 7/2005 | Sutej | 84/422.3 |
| 2005/0257672 | A1 * | 11/2005 | Arimoto | 84/738 |
| 2006/0156910 | A1 * | 7/2006 | Yoshino | 84/723 |
| 2009/0139387 | A1 * | 6/2009 | Toda | 84/422.3 |
| 2009/0183627 | A1 * | 7/2009 | Susami | 84/735 |
| 2010/0180750 | A1 * | 7/2010 | Steele | 84/422.3 |
| 2011/0056361 | A1 * | 3/2011 | Steele | 84/422.3 |
| 2011/0116634 | A1 * | 5/2011 | Norman | 380/277 |
| 2012/0048099 | A1 * | 3/2012 | Wissmuller | 84/723 |
| 2012/0060669 | A1 * | 3/2012 | Ryan et al. | 84/723 |
| 2012/0060670 | A1 * | 3/2012 | Truchsess | 84/724 |

* cited by examiner

*Primary Examiner* — David S. Warren
(74) *Attorney, Agent, or Firm* — William C. Schrot

(57) ABSTRACT

An electronic high-hat circuitry system allows the drummer to manually choose the sounds that an electronic high-hat makes when the drummer's foot is off of the pedal and the high-hat instrument is struck. When the pedal is at or near the top of its travel, a primary circuitry switch disables normal foot-controlled positioning circuitry and enables a secondary circuit that sends a selected positioning signal to a drum module. When the pedal is again pressed down, the primary circuitry switch returns control to the primary, pedal controlled circuit. An optional tertiary circuit allows for the choosing of a different sound when the secondary circuit is activated and the high-hat cymbal is tilted. A control panel is used by the drummer to select the desired high-hat sounds of the secondary and tertiary circuits. Also, high-hat instruments are introduced that have removable foot pedals, or no foot pedal.

20 Claims, 32 Drawing Sheets

Fig. 12d
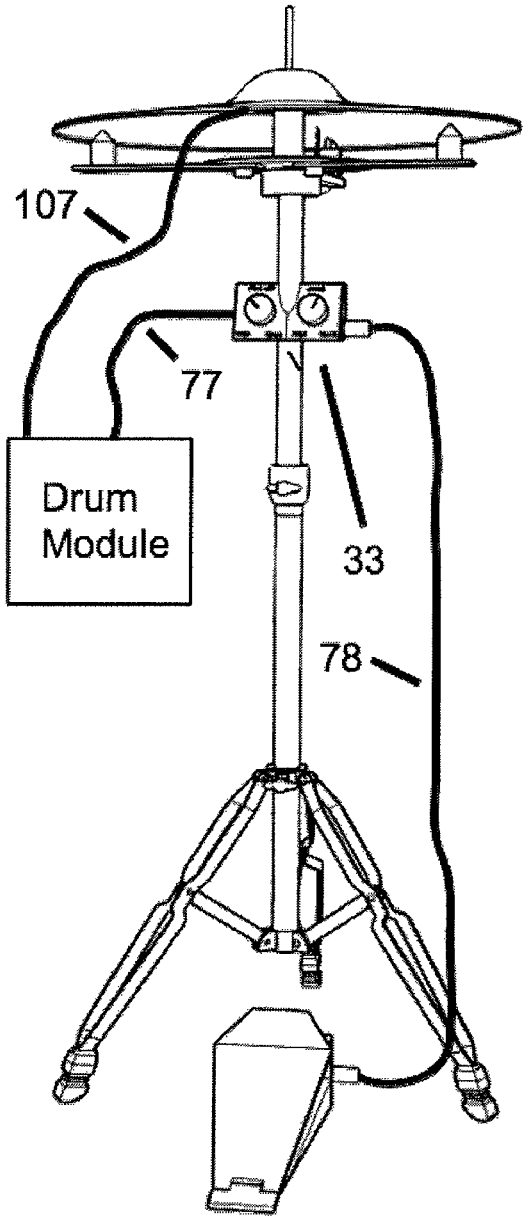
Fig. 12e
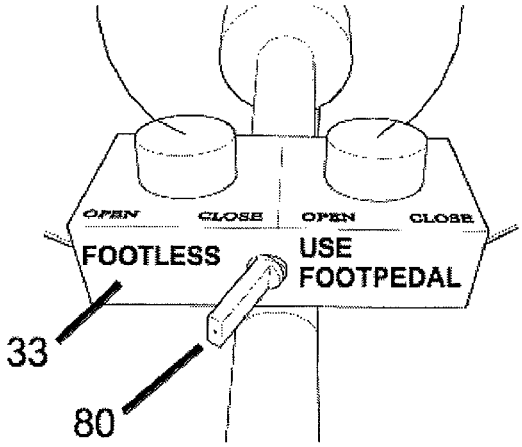
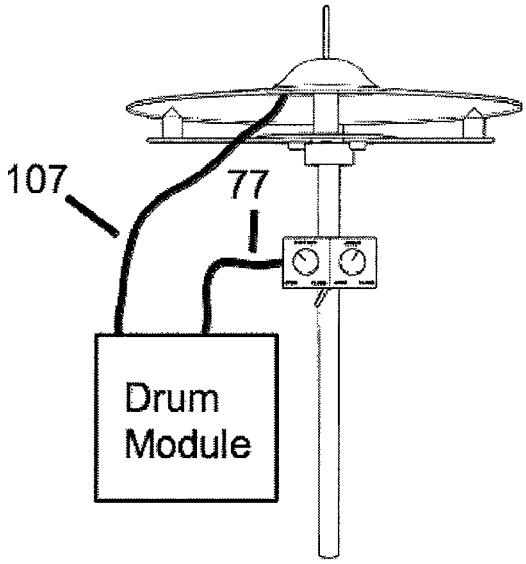
Fig. 12f

Fig. 16a
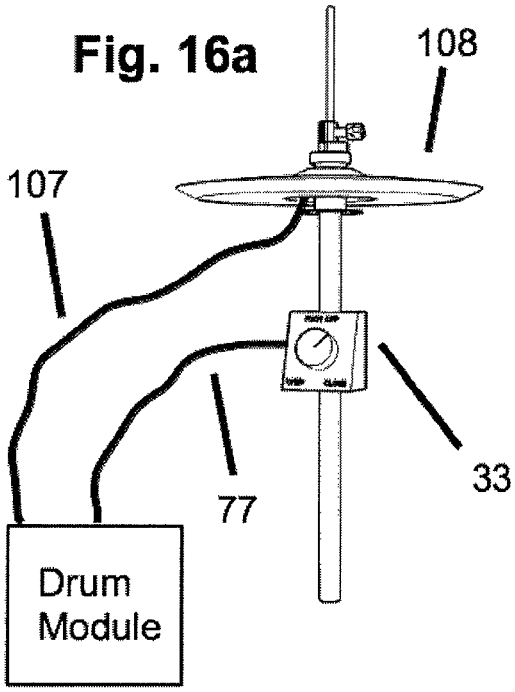
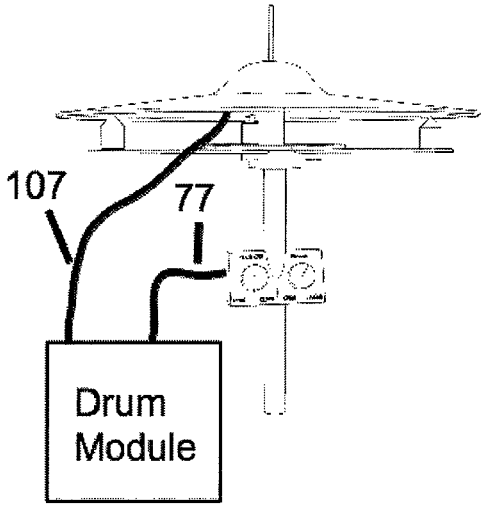
Fig. 16b
Fig. 16c
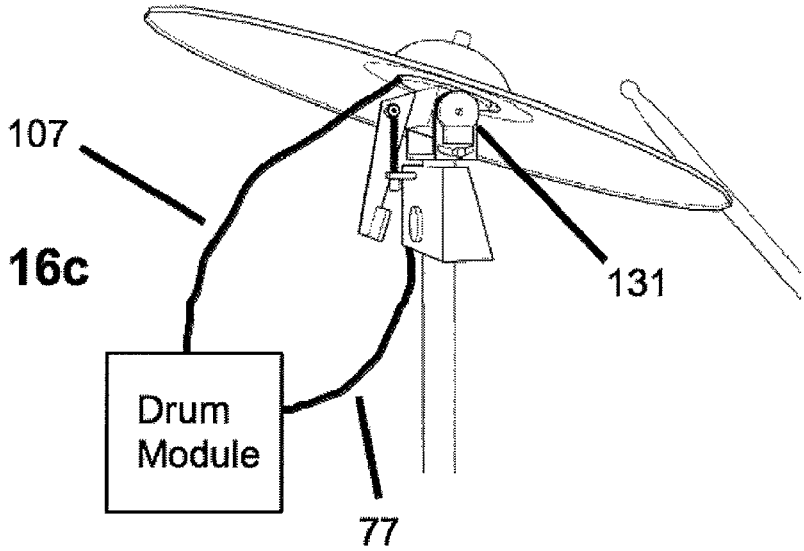

ELECTRONIC HIGH-HAT CIRCUITRY SYSTEM

CROSS REFERENCE TO RELATED APPLICATION AND CLAIM TO PRIORITY

This application is a continuation-in-part of U.S. application Ser.No. 12/321,243, filed Jan. 20, 2009, now issued as U.S. Pat. No. 7,838,753, the disclosure of which is incorporated herein in its entirety and to which priority is claimed.

FIELD OF THE INVENTION

The present invention relates to an electronic percussion instrument, and in particular, an electronic drum that electronically produces sounds simulating the sounds of acoustic drums.

BACKGROUND OF THE INVENTION

Electronic drums have been in use for several years now, and the technology is fairly straight forward. Put simply, a piezo electronic element generates a small but detectable current when the element is vibrated. These piezo elements are embedded into pads, cymbals or tubes, and the electrical output is routed to signal processors, commonly referred to as drum modules or "brains." Each piezo signal is assigned a sound by the drummer, through the programming function of the drum module. If a particular pad is assigned a snare drum sound, for example, a sound pattern is artificially generated by the drum module when electrical inputs from the pad are detected, and these sounds are routed out of the module for amplification. Literally hundreds of different sound patterns can be generated, and a typical drum set uses from 5 to 50 sounds, depending upon the sophistication of the drum set.

The high-hat instrument presents unique problems when it comes to generating an artificial sound pattern. The instrument that is simulated has two cymbals, one suspended over the other, as shown in FIG. 1. The upper cymbal 101 is suspended on a rod 103, and is spring-loaded up and away from the lower cymbal 102. A foot pedal 104, connected to the rod 103, is used to bring them together. The instrument makes a wide variety of sounds, depending upon the pressure exerted upon the pedal, the proximity of the cymbals, and the force with which the cymbal is struck. The instrument also makes a variety of sounds without striking; just pressing down with the foot brings the cymbals together, and makes a "chick" sound.

FIG. 2 shows a typical electronic high-hat arrangement that attempts to reproduce the sounds from the instrument depicted in FIG. 1. In order to simulate this instrument electronically, two inputs are needed; the position of the foot pedal 109 and the piezo signal from the impact sensitive electronic cymbal 108. The foot pedal 109 position is usually expressed to the drum module 106 through a voltage change that correlates to the pedal position. Typically, a constant voltage is sent to the pedal. Resistors come into play as the pedal is depressed. The altered voltage is sent back to the drum module, and the module detects the difference in the voltage. In some cases, a potentiometer is used to vary the voltage of the positional signal as the pedal is raised or lowered. Both the cymbal and the pedal are connected to the module using electrical cables 107, 105. A corresponding sound is generated in the drum module 106 based upon these two inputs. Note that there is no rod connecting the pedal to the high-hat cymbal.

As more bass drum notes became desirable in modern music, a second bass drum pedal was introduced, enabling drummers to play bass drum notes with both feet. Unfortunately, this requires drummers to take their foot off of the high-hat instrument, which leaves the upper cymbal suspended above the lower one in acoustic drum sets. To make matters worse, metal high-hat cymbals are generally very thick and produce an unpleasant "clanging" noise when they are struck without contacting their paired lower cymbal. Therefore, removing the foot from the high-hat generally renders the instrument un-playable, and most drummers immediately switch to a ride cymbal even though a high-hat sound is desired.

FIG. 1 shows a conventional acoustic high-hat in the at-rest position, which is achieved using a lifting spring. Pedal 104 is fully raised and attached to rod 103 and that cymbal 101 which is also attached to rod 103 is thereby also fully raised. Note the undesirable gap between cymbals 101 and 102.

In FIG. 1*a*, the pedal 104*a* has been depressed, the paired cymbals 101*a* and 102*a* have been drawn together, and the high-hat is ready for playing.

There are a few inventions on the market that attempt to make the acoustic high-hat playable when the foot is removed, and they usually involve a locking device that holds the pedal down when the foot is pulled away. When the locking device is disabled, the hi hat works normally again. The problem is that levers must be manipulated while trying to play the drums in order to lock or unlock a mechanical clutch, and it is sometimes difficult to consistently get the correct pedal pressure. Most drummers simply abandon the high-hat instrument rather than work the clutch mechanism. There are also devices that use light beams to sense when the drummer's foot has left the pedal, and an electromagnetic solenoid is activated to physically move the pedal to a preset position. These devices are expensive and complex, not suitable for most electronic high-hat control pedals, and are rarely used.

Unfortunately, prior art electronic high-hat devices have mimicked the conventional high-hat instrument all too well. When the foot leaves the instrument, this same irritating clanging noise is generated by electronic high-hats, and the instrument is generally abandoned when a second bass drum pedal is used.

SUMMARY OF THE INVENTION

The present invention solves some or all of the above-noted problems, allowing the drummer that uses an electronic high-hat to continue to generate pleasant closed high-hat sounds when the drummer's foot leaves the high-hat instrument, utilizing a secondary circuit to manually set the sound that the instrument will make. An optional tertiary circuit is introduced, that produces yet another selectable sound when the high-hat cymbal is tilted when struck by the drummer.

An objective of the invention is to allow a drummer playing an electronic high-hat to continue to make pleasant high-hat sounds when the drummer's foot leaves the high-hat pedal.

Another objective is to have a primary circuitry switch that disables the primary pedal actuated positioning circuit when the foot is removed from the high-hat pedal, said primary circuitry switch simultaneously activating a secondary circuit that is energized when the drummer's foot leaves the high-hat pedal.

Yet another objective is to have electronic controls in the secondary circuit that manually vary the current of the high-hat positioning signal that is sent to the drum module.

A further objective is to provide accent notes using an optional tertiary circuit that controls the output to the drum module when the secondary circuit is activated and the high-hat cymbal is tilted after being impacted.

Another objective is to place a control panel within easy reach of the drummer that determines the sound that the high-hat will make when the instrument is struck whenever the foot is removed, with simple manual controls for setting the output of the secondary and tertiary circuits.

A further objective is to have a system that works in every configuration of electronic high-hat instruments.

Yet another objective is to have a high-hat that has a removable foot pedal, or no foot pedal at all.

In accordance with a preferred embodiment of the invention, there is disclosed an electronic high hat circuitry system that utilizes a primary, foot pedal controlled circuit that sends a positioning signal to an electronic drum module, a primary circuitry switch that is activated when the pedal is at or near the top of its travel thereby disabling the primary circuit and simultaneously activating a secondary circuit. This secondary circuit varies the positioning signal to the electronic drum module in a manner similar to the primary circuit with one major difference; the signal is manually set by the drummer through a control panel. An optional tertiary circuit is introduced, which allows the drummer to select a sound that is yet again different from the primary or secondary circuits. This tertiary circuit is primarily used for accent notes, and it is activated when the secondary circuit is in use and the cymbal is tilted. This tertiary circuit signal is also manually selected by the drummer.

Other objectives and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various fauns. It is to be understood that in some instances various aspects of the invention may be shown exaggerated or enlarged to facilitate an understanding of the invention.

FIG. 12*d* depicts a three circuit high-hat.

FIG. 12*e* depicts a three circuit high-hat jumper switch.

FIG. 12*f* depicts a three circuit high-hat after using a jumper switch to eliminate the pedal.

FIG. 16*a* depicts a single circuit footless high-hat instrument.

FIG. 16*b* depicts a two circuit footless high-hat instrument.

FIG. 16*c* depicts a footless high-hat using a tilt actuated potentiometer.

DETAILED DESCRIPTION OF EMBODIMENTS OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

There are many different configurations used in electronic high-hat instruments, and my invention works with all of them. In my Figures, I will use common numbering for the parts that serve identical functions, regardless of configuration differences.

Figure 1:
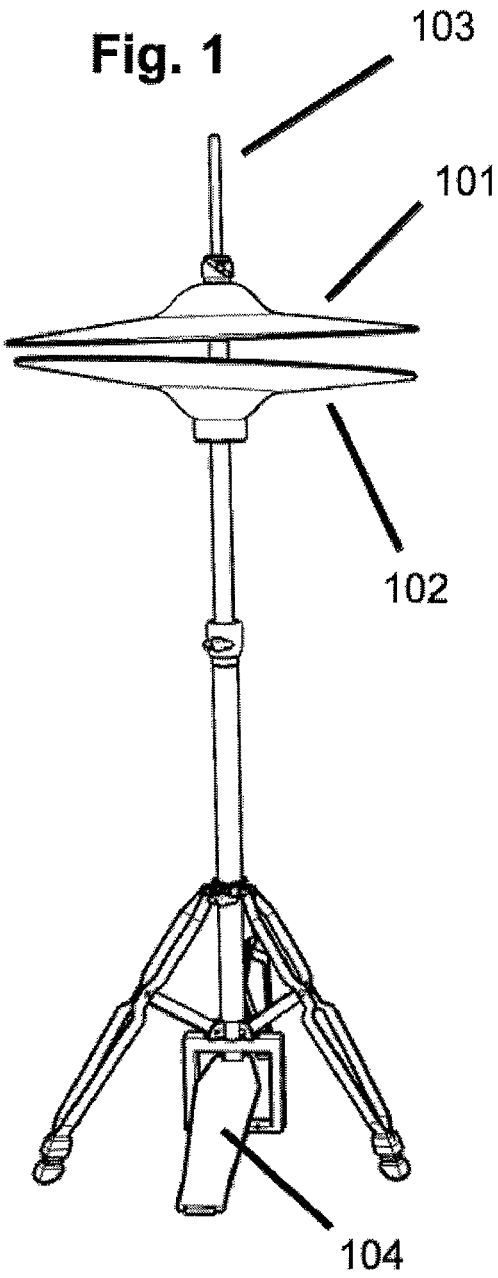
FIG. 1 depicts an acoustic high-hat in the open, at-rest position.
Figure 1A:
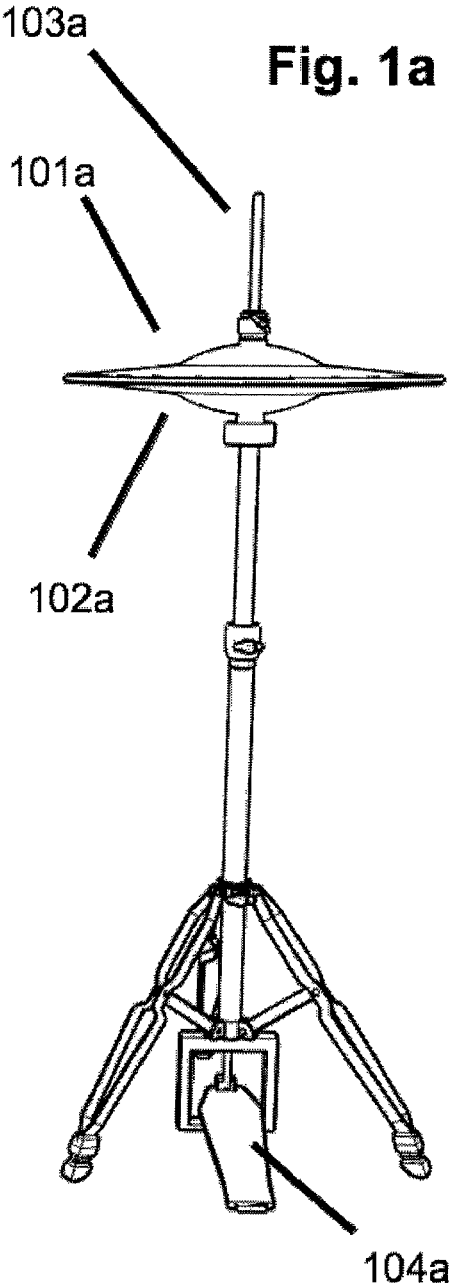
FIG. 1*a* depicts a high-hat with the pedal depressed.
Figure 2:
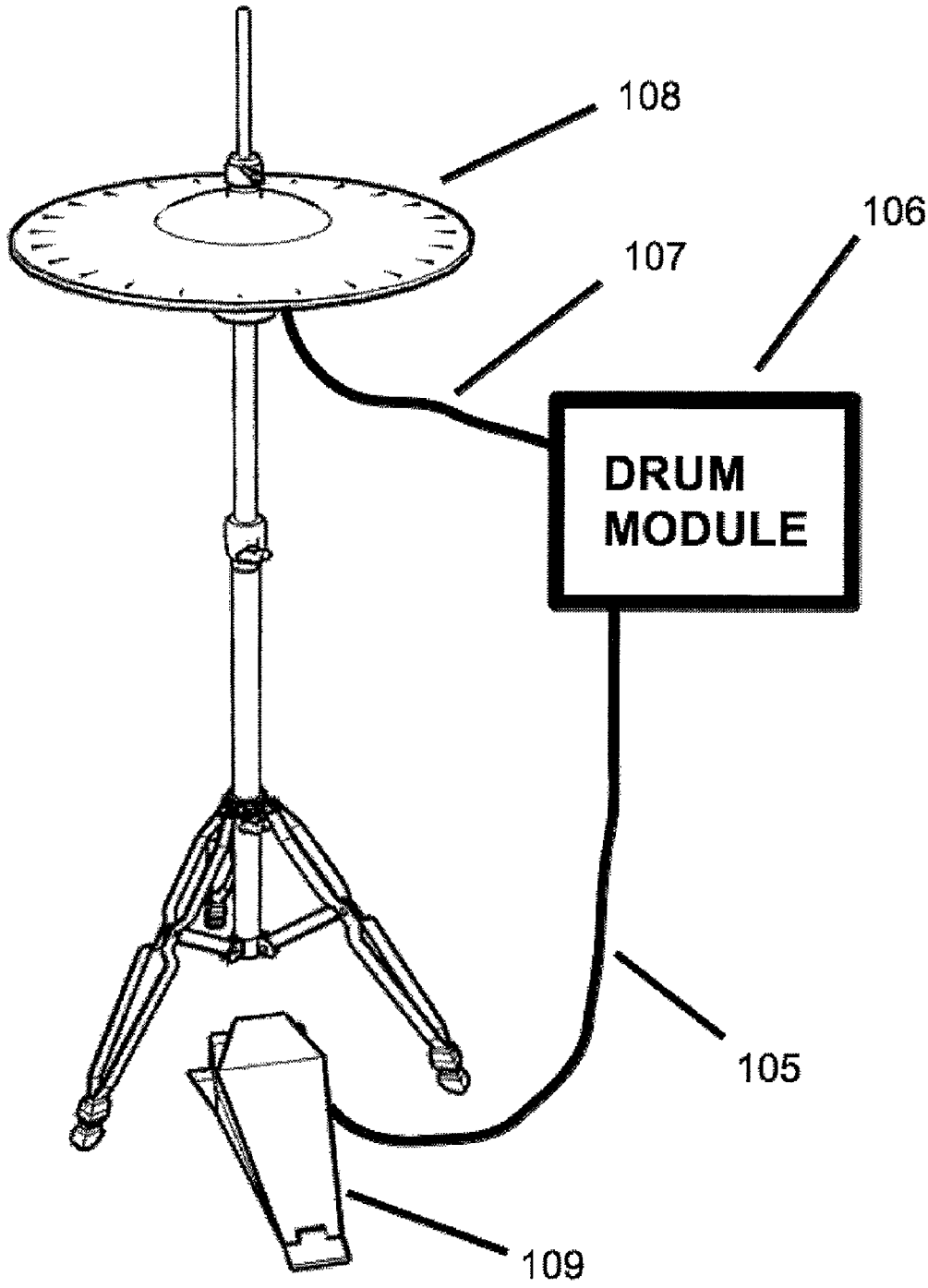
FIG. 2 depicts a typical electronic high-hat arrangement.
Figure 3:
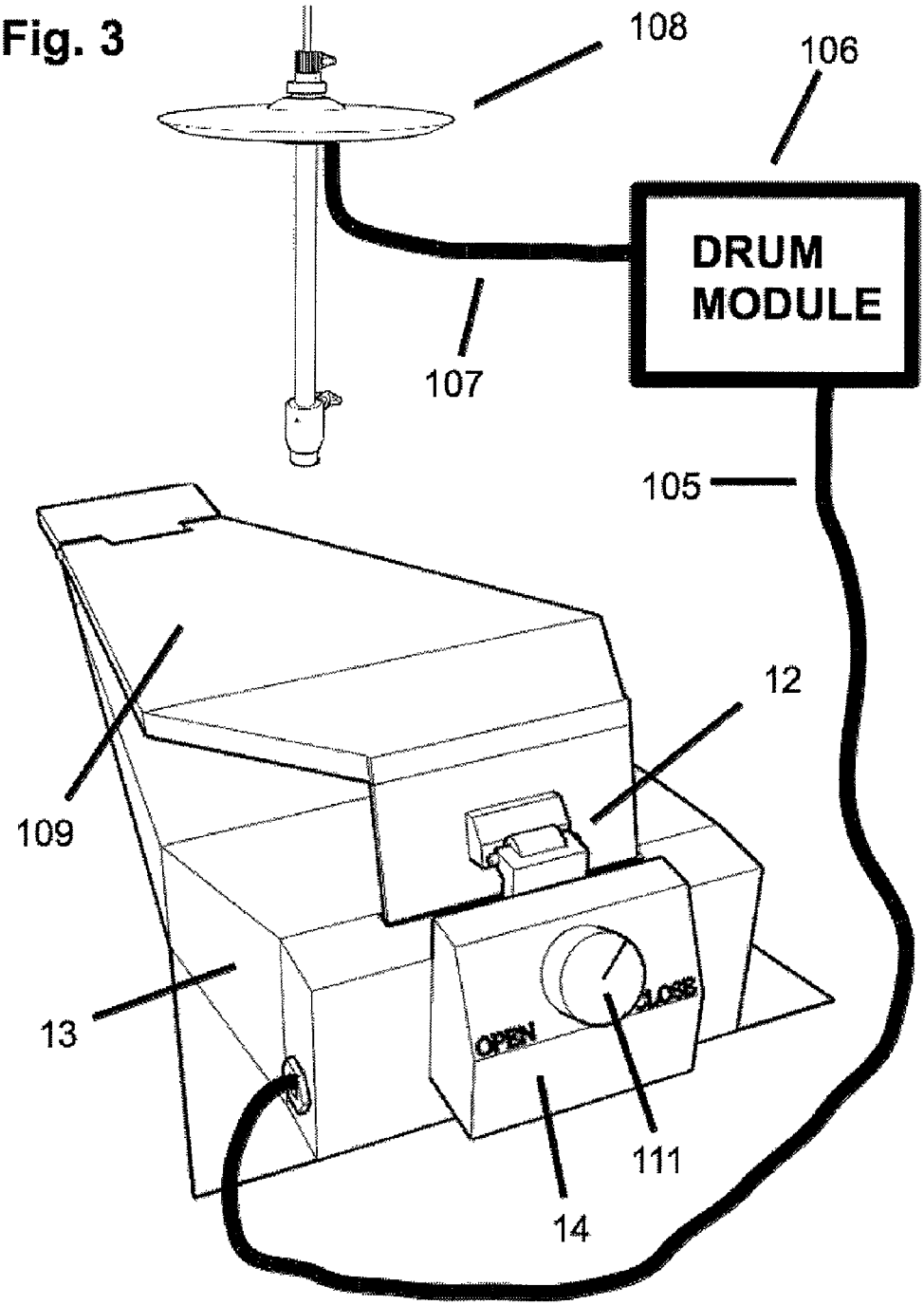
FIG. 3 depicts the components for an embodiment of my invention.

As shown in FIG. 3, elements of an embodiment of the present invention include: an impact sensitive electronic cymbal or other electronic triggering device 108; a foot pedal which has an at-rest position that is at the top of its travel length 109, a primary control circuit 13, which varies the control current sent to the drum module 106 based upon foot pedal 109 position; a secondary circuit 14 which varies the control current sent to the drum module based upon a manual setting; a primary circuitry switch 12 that disables the primary circuit and energizes the secondary circuit when the pedal 109 is at or near the full-up, at-rest position; and a manual control knob 111 that allows the drummer to select the desired high-hat sound produced by the secondary circuit.

The secondary circuit varies the current to the drum module just like the primary positioning circuit, except that the current is varied by means of a control knob, as opposed to the position of the foot pedal. Using this control, the drummer can preselect a sound ranging from a full closed to a full open high-hat, and when the foot is removed, this is the control signal that will be sent to the drum module. When the foot is again placed on the pedal and pressed down, the switch contact is broken, the secondary circuit is disabled, and the primary positioning circuit controlled by the foot pedal is utilized once again.

Figure 4A:
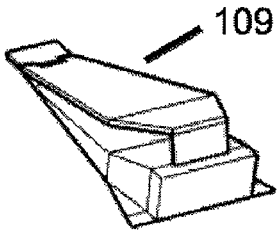
FIG. 4*a* depicts a prior-art electronic high-hat control pedal.
Figure 4B:
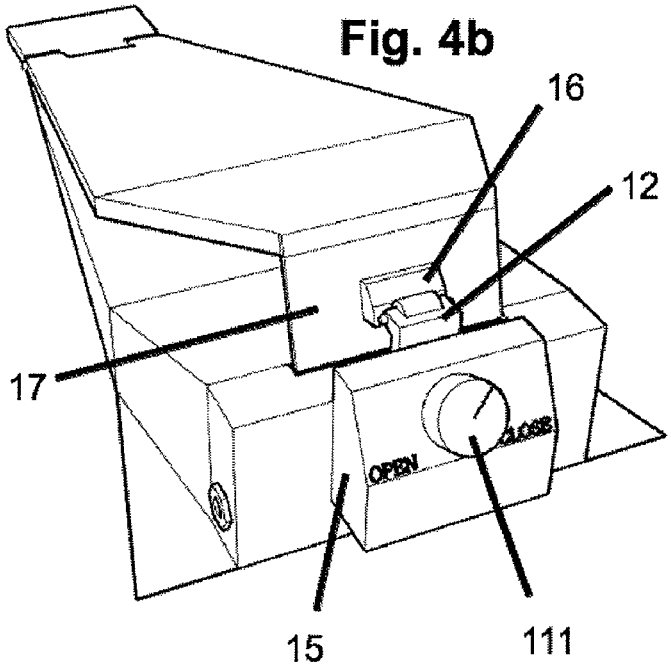
FIG. 4*b* depicts a high-hat pedal with a retrofitted external secondary circuit and a control panel.

FIG. 4*a* shows a prior-art electronic high-hat control pedal, wherein the foot pedal 109 is part of a pedal assembly that houses and directly controls the primary control circuit. FIG. 4*b* shows the same pedal assembly that has been retrofitted with a primary circuitry switch 12, an external secondary circuit box 15 with manual control knob 111, and a primary circuitry switch cam 16 that has been mounted to the pedal plunger 17.

Figure 4C:
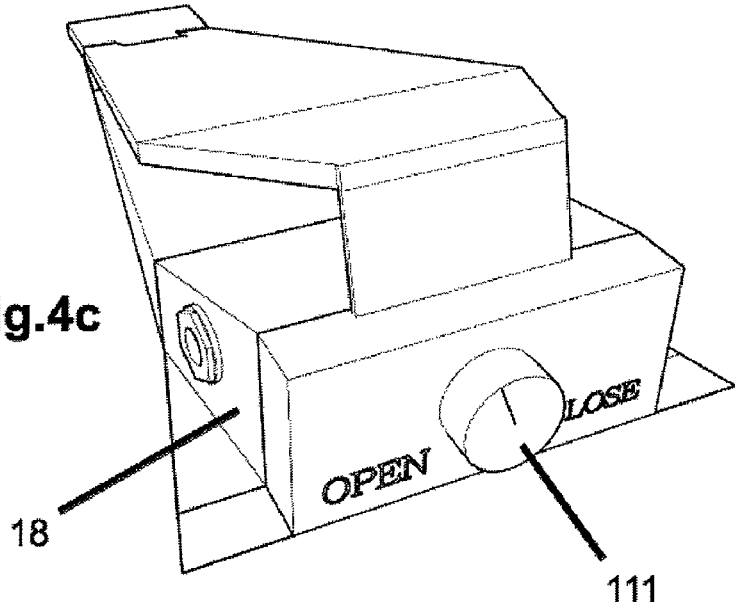
FIG. 4*c* depicts an electronic high-hat pedal with an internal secondary circuit and an external control panel.

FIG. 4*c* shows an electronic high-hat control pedal with a secondary circuit built into the existing electronics bay 18 that forms the base of the pedal. The primary circuitry switch (not shown) is internally mounted, and has the same function as the retrofitted example in FIG. 4*b*. The control knob 111 still determines the sound that the pedal will make when the foot is removed.

Figure 5A:
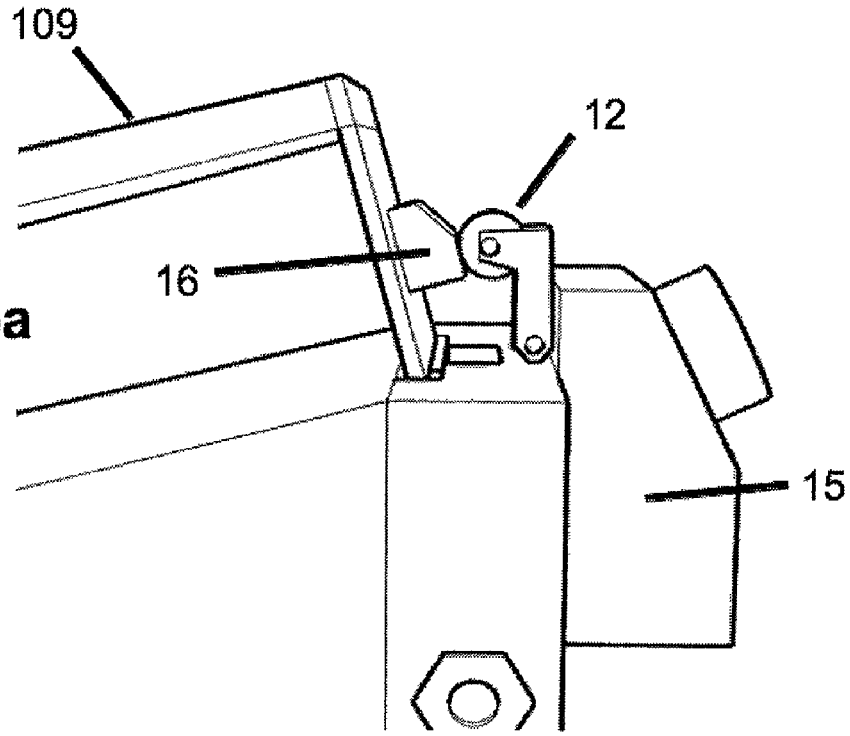
FIG. 5*a* depicts a primary circuitry switch when the pedal is in the at-rest, full up position.
Figure 5B:
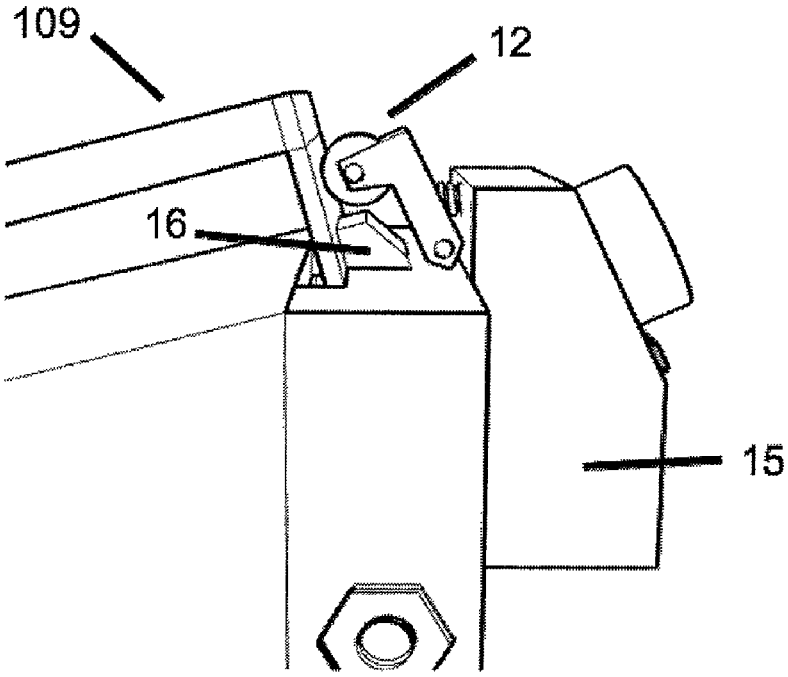
FIG. 5*b* depicts a primary circuitry switch when the pedal has been depressed.
Figure 11A:
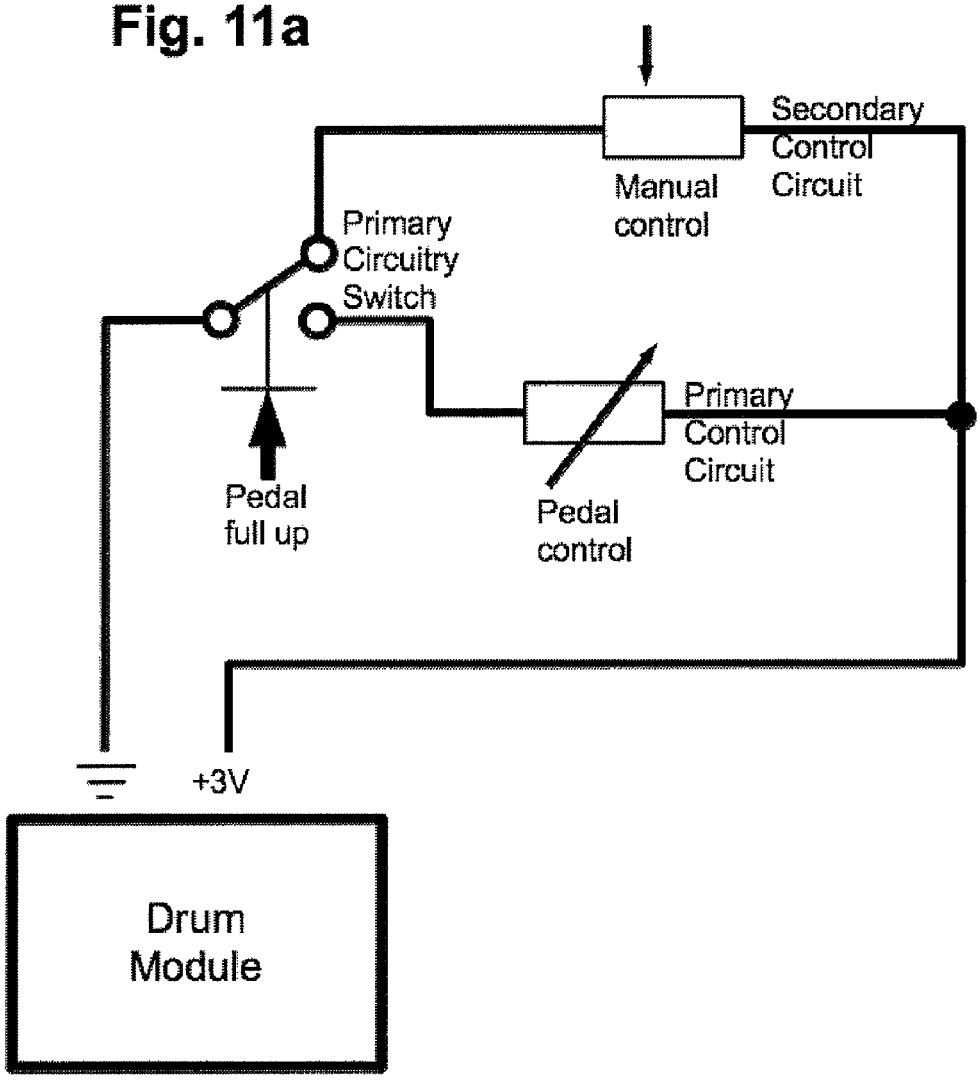
FIG. 11*a* depicts the circuitry logic of an electronic high-hat circuitry system having primary and secondary control circuits.

FIGS. 5*a* and 5*b* show a typical foot pedal primary circuitry switch in use. When the pedal 109 is in the full-up position as in FIG. 5*a*, the primary circuitry switch cam 16 forces the primary circuitry switch 12 towards the secondary circuit box 15, activating the secondary circuit. As the pedal is depressed as in FIG. 5*b*, the primary circuitry switch 12 moves, the secondary control circuit is deactivated, and the primary control circuit in the foot pedal is activated. A circuitry logic diagram is presented in FIG. 11*a*, starting with a typical 3 volt power supply from the depicted drum module. In this example, a voltage change is produced by all control circuits, and this voltage change is detected by the drum module and used to produce an appropriate high-hat sound.

Figure 6:
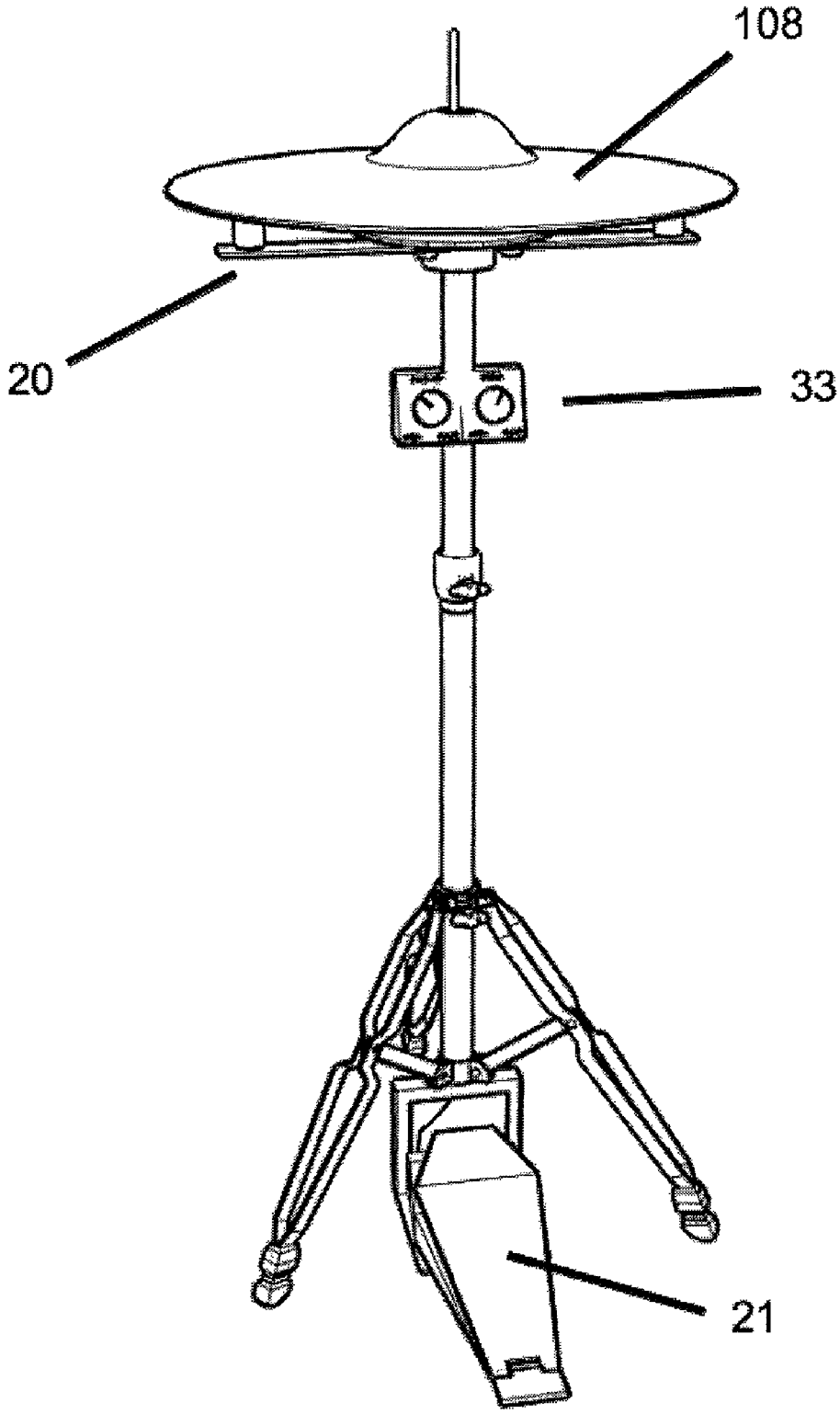
FIG. 6 depicts an embodiment of the invention with a tertiary circuit.

FIG. 6 depicts another embodiment of my invention. The foot pedal assembly 21 includes the pedal, the primary control circuit electronics, along with an internal primary circuitry switch. The electronics control box 33 includes a front control panel, and contains the secondary and tertiary circuitry. There is a tertiary circuit cymbal platform 20 and an impact sensitive electronic cymbal 108.

A favorite trick of many drummers is to raise the high-hat pedal slightly when hitting accent notes, and getting a momentary "sizzle" sound from the high-hat. My invention allows the drummer to control these accent notes, for the first time, when their foot is off of the pedal, utilizing an optional tertiary control circuit. When the cymbal is tilted as in FIG. 7*b*, the tertiary circuitry switch 26 is actuated, and transfers control to the tertiary circuit. The control knob 32 for the tertiary circuit has been labeled "sizzle" on the right side of the control panel 31 in FIG. 8*a*, and so has the slider device 32*a* on the right side of the control panel 31*a* in FIG. 8*b*. This tertiary "sizzle" circuit remains active for as long as the cymbal is tilted and the foot pedal is not depressed. The switches, resistors, potentiometers or other electronic parts used by the secondary and tertiary circuits to vary the positioning current are housed in the electronics control boxes 33 and 33*a*. In FIG. 8*b*, slider device controls are depicted. These slider device controls 30*a* and 32*a* may utilize potentiometers, progressive resistors, or other electronic devices to vary positioning current.

Figure 11B:
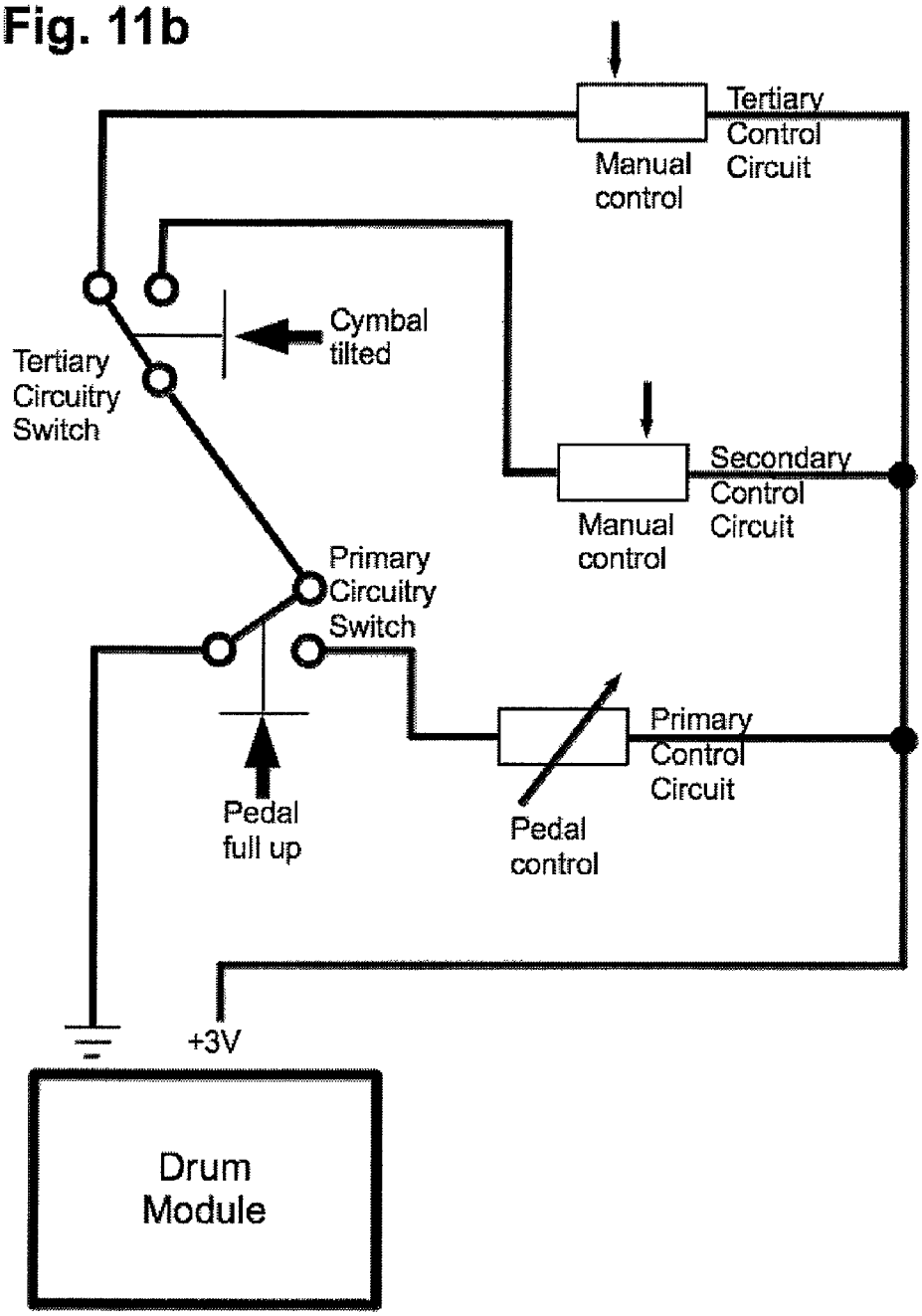
FIG. 11*b* depicts the circuitry logic of an electronic high-hat circuitry system having primary, secondary and tertiary control circuits.

Note that the tertiary "sizzle" circuit is armed when the drummer's foot is off of the pedal. When the drummer's foot is on the pedal, the primary circuit pedal position controls the output to the drum module regardless of cymbal tilt. A circuitry logic diagram is presented in FIG. 11*b*, starting with a generic 3 volt power supply from the depicted drum module. In this example, a voltage change is produced by all control circuits, and this voltage change is detected by the drum module and used to produce an appropriate high-hat sound.

Figure 7A:
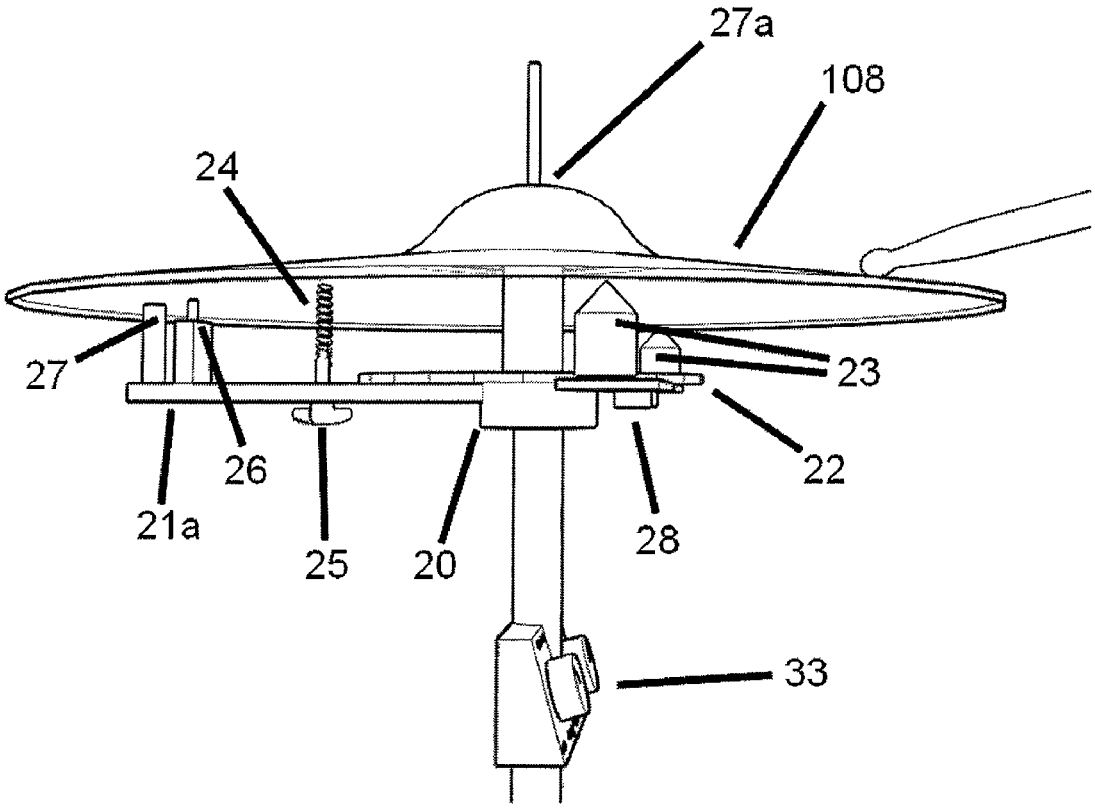
FIG. 7*a* depicts a tertiary circuit cymbal platform with the cymbal in the at-rest position.
Figure 7B:
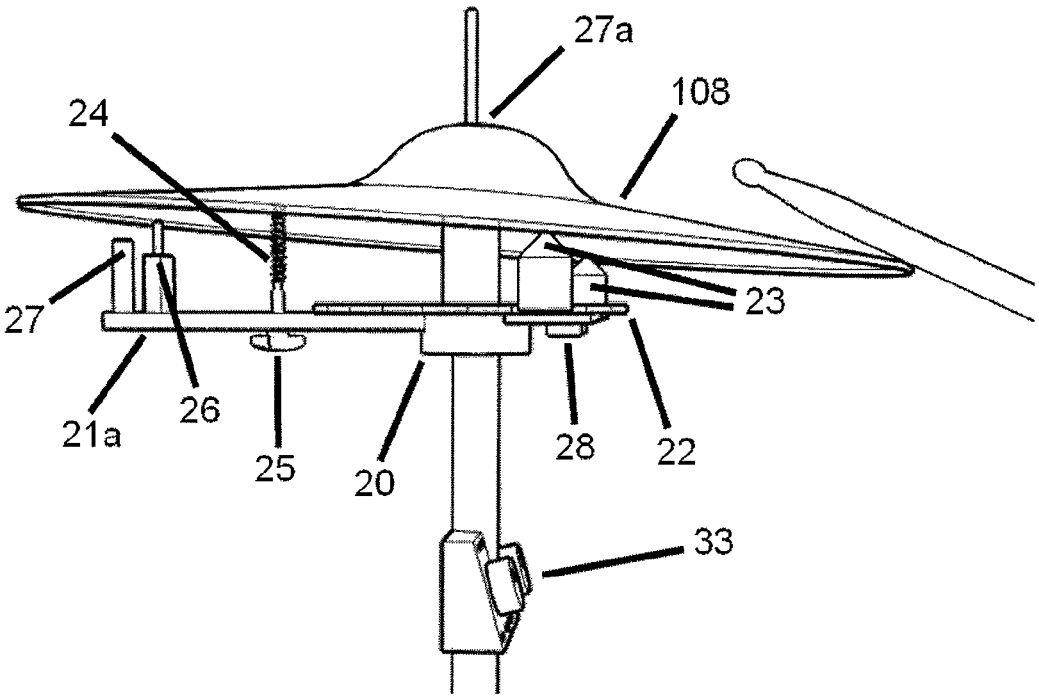
FIG. 7*b* depicts a tertiary circuit cymbal platform with the cymbal that has been tilted by the drummer.
Figure 7C:
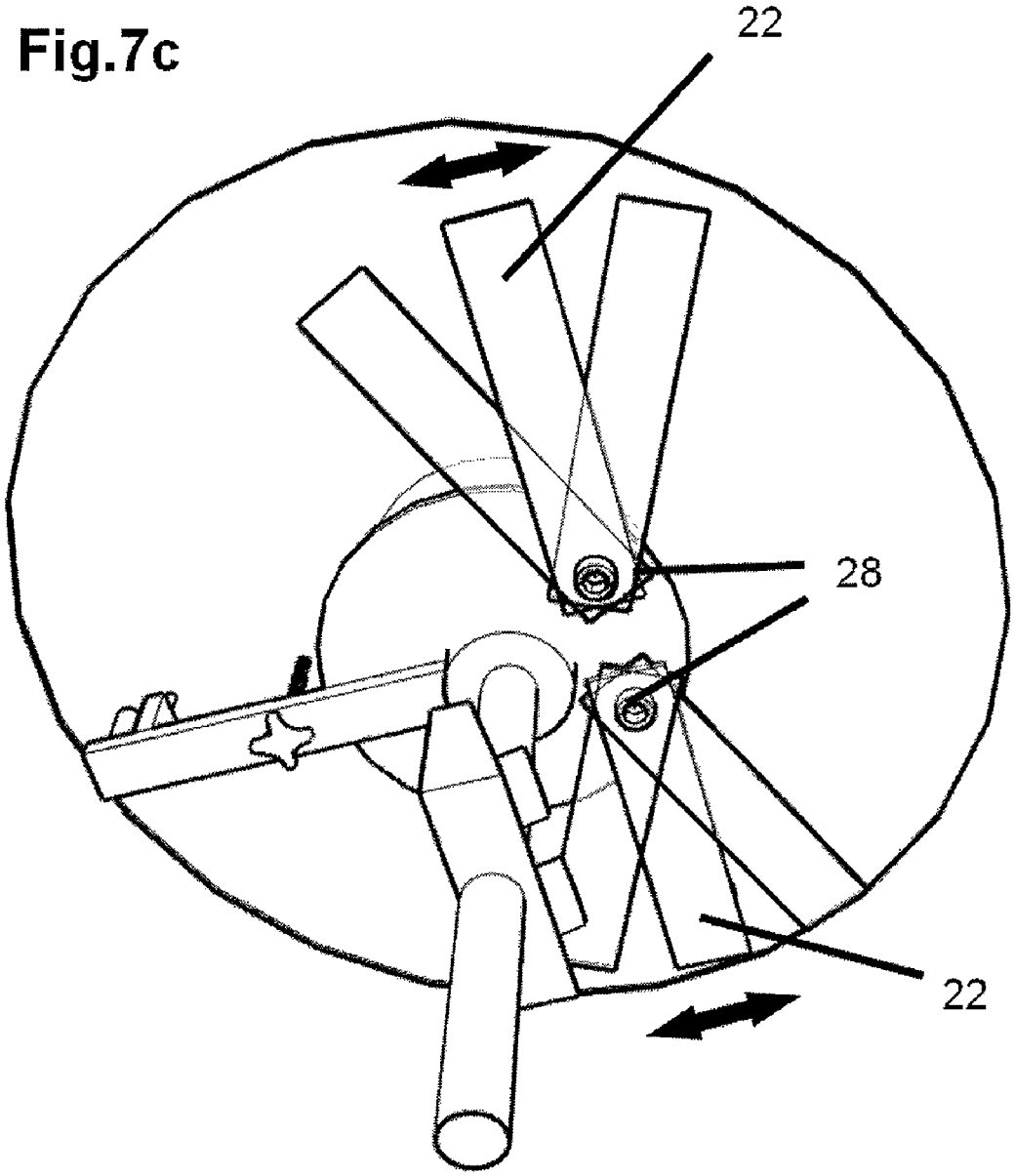
FIG. 7*c* depicts the underside of a tertiary circuit cymbal platform with adjustably positioned cymbal stanchion arms.
Figure 8A:
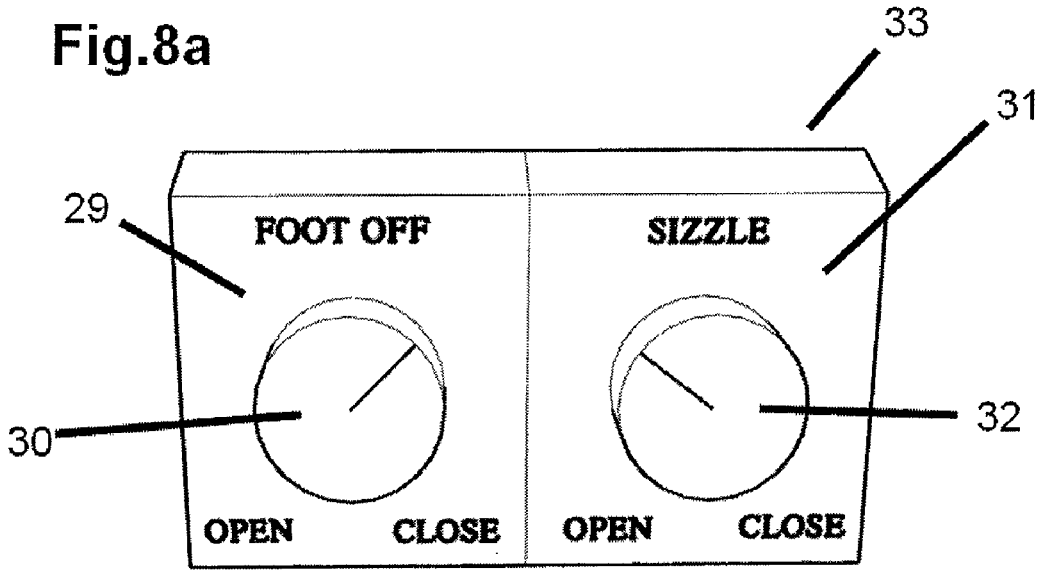
FIG. 8*a* depicts a secondary and tertiary "sizzle" circuitry control panel.
Figure 8B:
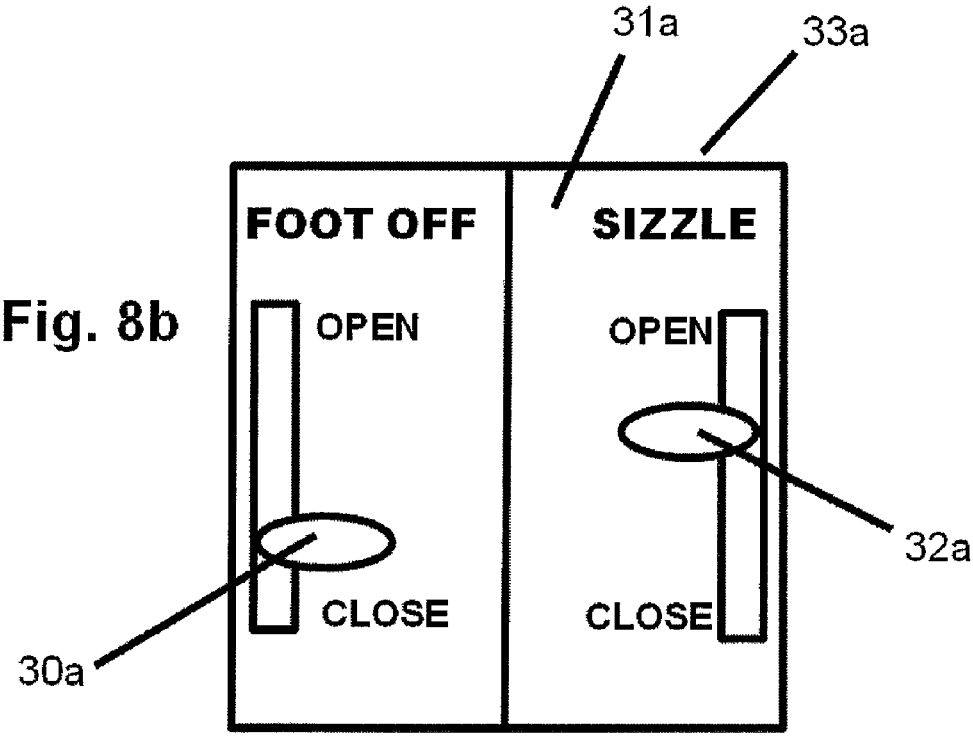
FIG. 8*b* depicts a control panel with slider control devices

FIGS. 7*a* and 7*b* show details of the tertiary circuit cymbal platform 20. The cymbal 108 is shown transparently in the drawings, and would include one or more piezo or other electronic triggers which are not shown. There is a central support post 27*a* that allows the cymbal to pivot at the center, and two fulcrum stanchions 23 mounted on two support arms 22. The central support post 27*a* could be made out of a flexible material, or the cymbal may have a flexible gimbal at the top. As the cymbal tilts in FIG. 7*b*, the two arms with stanchions define a fulcrum line for the cymbal to tilt in a direction facing the drummer. If the cymbal were allowed to tilt in a random direction, the response of the tertiary circuitry switch 26 may become unreliable. These arms 22 can be adjustably positioned relative to the pivot point of the support post 27*a* using adjustment screws 28 in FIG. 7*c*, and the height of the fulcrum stanchions 23 is also adjustable (FIGS. 7*a*, 7*b*). When the cymbal edge is pressed down when struck as in FIG. 7*b*, the cymbal tilts while being supported and guided by the fulcrum stanchions 23, and the tertiary circuitry switch 26 is activated. There is an arm 21*a* that supports the tertiary circuitry switch 26, the return spring assembly 24 and 25, and the return stop 27. An adjustment device 25 is shown which varies the tension of the return spring. The return spring or other elastic device 24 is attached to the cymbal 108 and it brings the cymbal back to an at-rest position that deactivates the tertiary circuit, as depicted in FIG. 7*a*. In the at-rest position, the cymbal is supported by the return stop 27. If the return stop 27 is constructed of a soft material, the cymbal will not trigger a sound when the cymbal falls to the at-rest position. If this return stop 27 is made of a solid material, the cymbal will trigger a sound as if struck. The drummer can thereby double the number notes played, getting a second note each time the cymbal drops.

Figure 7D:
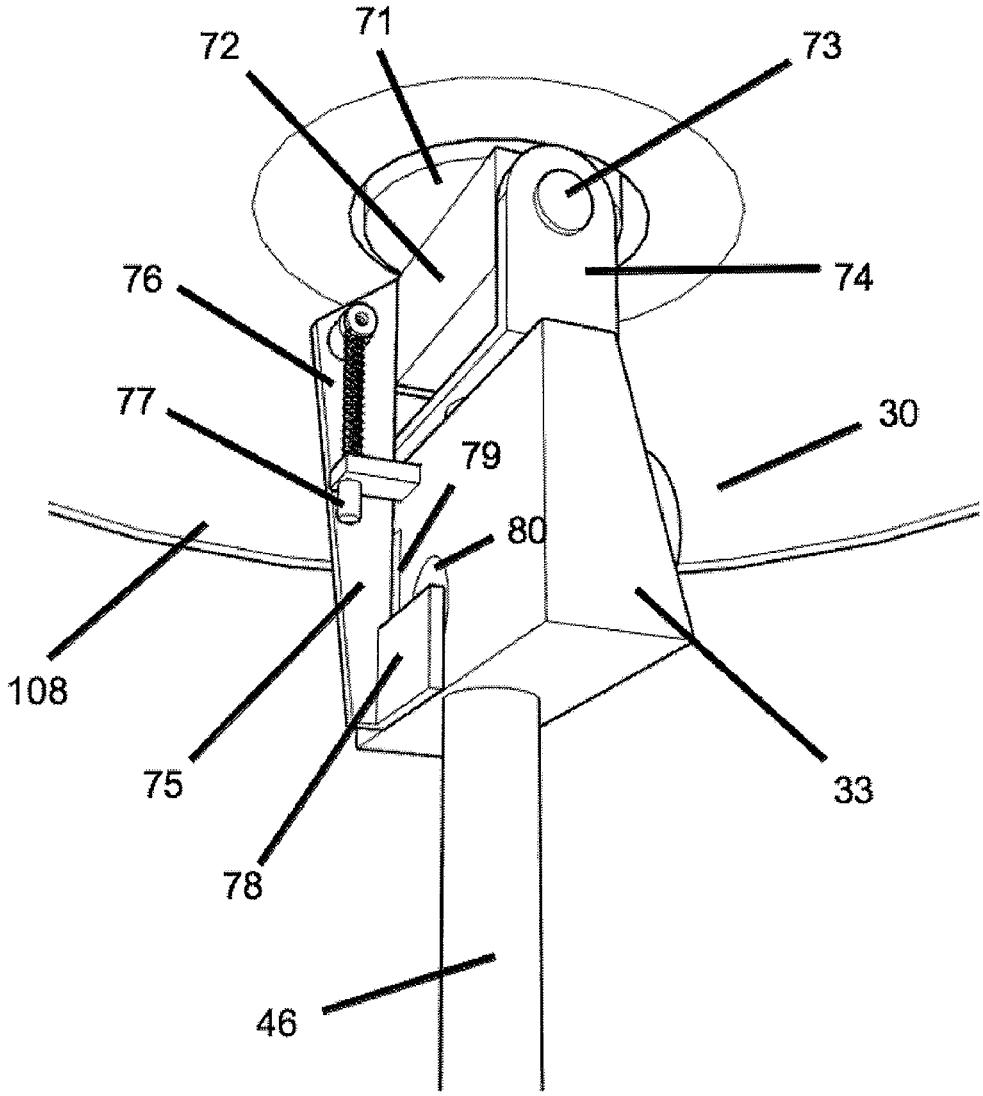
FIG. 7*d* depicts a cymbal mounted on a hub mounted on an axle.

FIG. 7*d* shows an alternate embodiment which activates a tertiary "sizzle" control circuit when the cymbal is tilted. The cymbal 108 has been secured to a mounting pad 71 that is attached to a hub 72. This hub 72 revolves around an axle 73 that is supported by a bracket 74 that is attached to the high-hat support tube 46. As the cymbal and hub rotate on the axle, the tilting axis of the invention is defined and the cymbal movement is limited to this axis. An arm 75 is attached to the hub 72 and the arm moves as the cymbal is tilted. A spring 76 pulls the rotating assembly into a flat cymbal position. A spring tension adjustment knob 77 allows the drummer to determine the force required to tilt the assembly. A tab 78 on the arm 75 comes to rest on an adjustable padded stop 80, and said tab also compresses the tertiary circuitry switch lever 79, shown here in the retracted position.

Figure 7E:
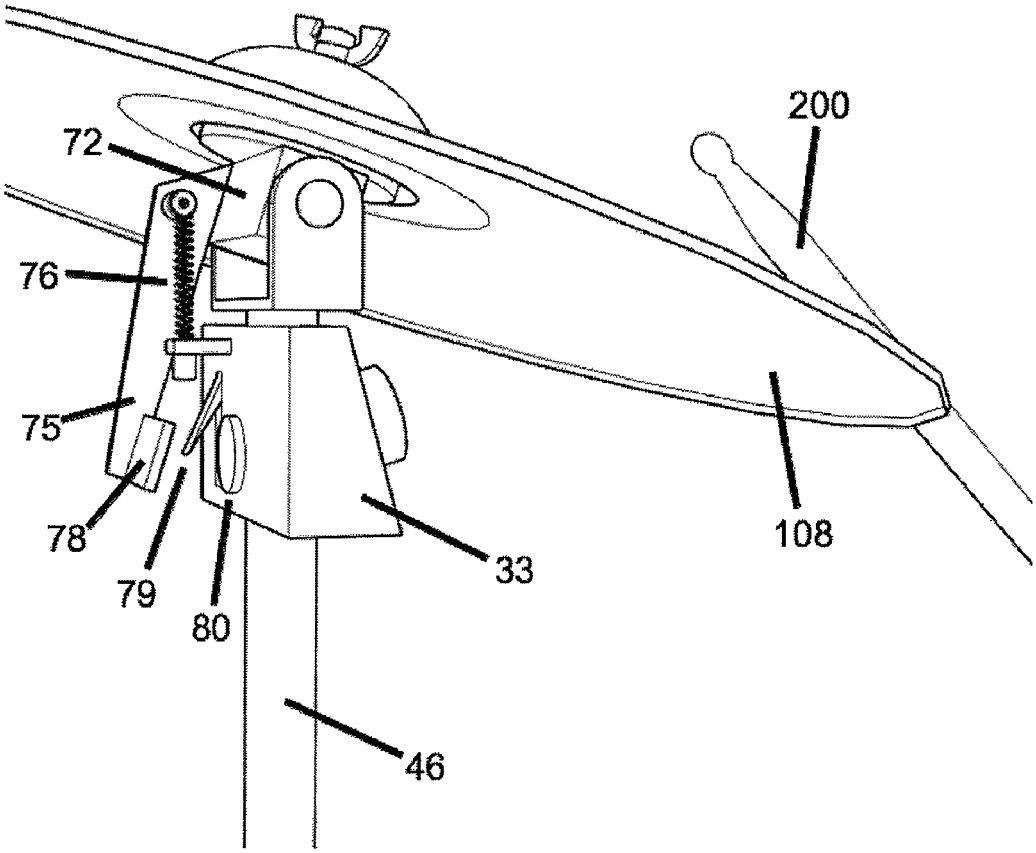
FIG. 7*e* depicts the cymbal of FIG. 7*d* in the tilted position.

In FIG. 7*e*, the cymbal has been shanked with a stick 200 and the cymbal has been forced to tilt. The cymbal 108, the hub 72 and the arm 75 have all rotated. The tab 78 has also rotated away from the padded stop 80 and the tertiary circuitry switch 79, which activates the tertiary control circuit.

Some of today's most advanced electronic high-hats do not have the positioning control circuit housed in the foot pedal as in FIG. 4*a*, but in the actual cymbal assembly. In these designs, the cymbal that is struck by the drummer is attached to a rod that is connected to the foot pedal, as in conventional acoustic high-hats. As the pedal goes up and down, the electronic cymbal also moves. Highly sophisticated pressure sensors or elastic switches are used to vary the control current sent to the drum module. Since my design does not modify the control function of primary circuit mechanisms, my invention works with all types of existing electronic high-hats.

Figure 9A:
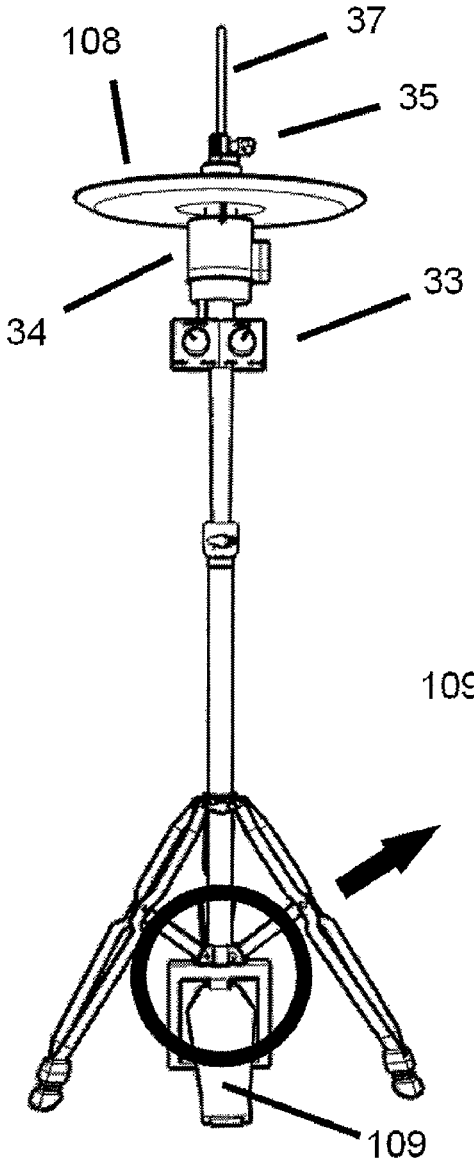
FIG. 9*a* depicts an electronic high-hat.

FIG. 9*a* depicts a modified generic modern electronic high-hat with the primary control circuit electronics housed at the top of the high hat stand. The foot pedal 109 is connected to a rod 37 that connects to a device that controls the primary control circuit, in this case, a device that resides in the primary circuit housing 34.

Rod 37 runs all the way through the instrument, and connects with the pedal 109 at the bottom. The cymbal 108 is attached to the rod using a clamp 35. The rod is spring-loaded to the full up position, as in conventional high hats. As the drummer's foot is lowered, this movement is sensed by the primary circuit pressure sensors (not depicted) which reside inside the primary circuit housing 34 and the primary control current is varied.

Figure 9B:
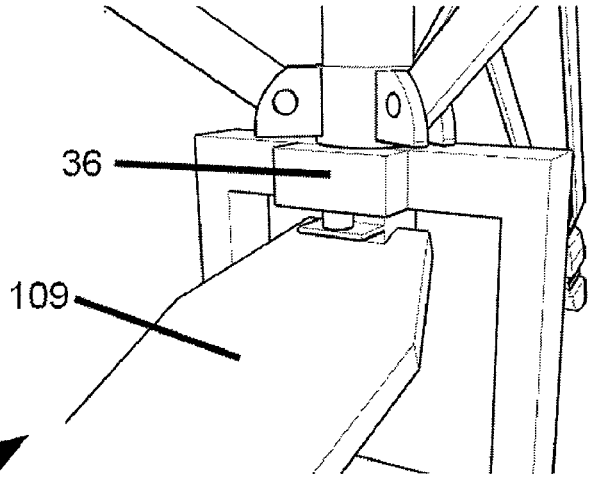
FIG. 9*b* depicts the base of an electronic high-hat device with the primary circuitry switch mounted above the pedal.
Figure 9C:
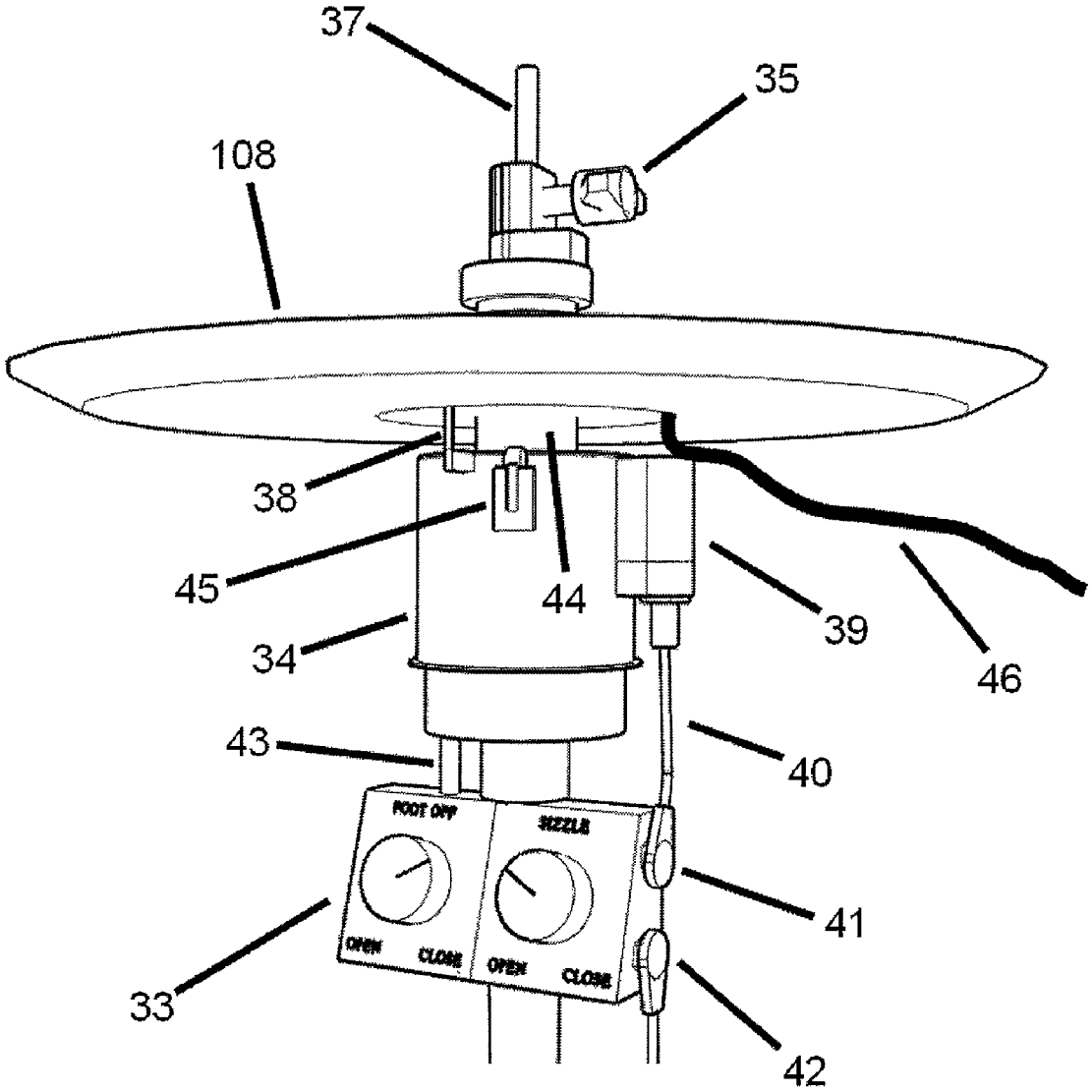
FIG. 9*c* depicts details of an electronic high-hat.

Some modifications may be made in order to play the high hat when the foot is removed, and these modifications are shown in FIGS. 9*a*, 9*b* and 9*c*. Secondary and Tertiary circuits have been added, along with corresponding controls 33.

In FIG. 9*b*, a primary circuitry switch 36 has been added to the base of the stand, and this switch has the same function as in previous embodiments. A disadvantage to this arrangement is that there needs to be an electrical connection between the switch and the other components at the upper end of the high-hat stand. An external cable would be unsightly for many users.

In FIG. 9*c*, an alternative primary circuitry switch 45 is depicted. As the foot pedal forces the cymbal downward, the compressor cylinder 44, which is part of the upper cymbal assembly, presses down on a spring-loaded sensor cylinder (not depicted) contained in sensor housing 34. As the sensor cylinder leaves the full-up position, the primary circuitry switch 45 is activated and the control current is varied by the primary control circuit. The output from this primary control circuit is sent out through the jack housing 39. In prior art, this output would go directly to the control input of the drum module, but in my invention, it is routed to the electronics control box 33 using connector 40 and jack 41. Note that only one control circuit is activated at any given time, and the circuit that is powered is the only one that will send signals to the drum module via the control jack 42 which leads to the drum module control input jack. Output line 46 is the pathway for the piezo triggering signal to be routed to the drum module when the impact sensitive electronic cymbal 108 has been struck.

An optional cymbal tilt switch 38 has been incorporated into the moving cymbal assembly. This switch transfers control to the tertiary or "sizzle" circuit when the cymbal is tilted, just as in other embodiments. Note that an electrical connection 43 is provided between the electronics control box 33 and the switches 38 and 45, which are mounted above it.

Figure 10A:
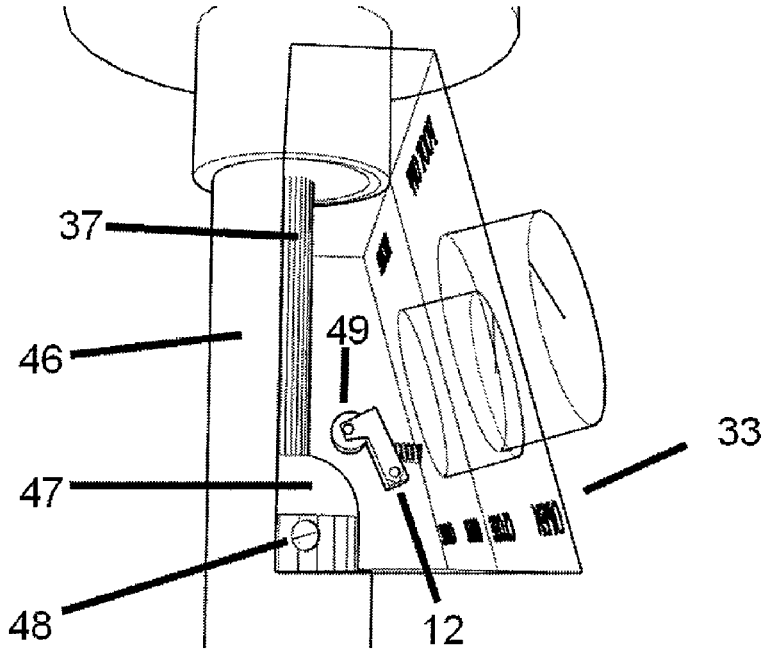
FIG. 10*a* depicts a primary circuitry switch that is contained within the electronics control box when the foot pedal is depressed.
Figure 10B:
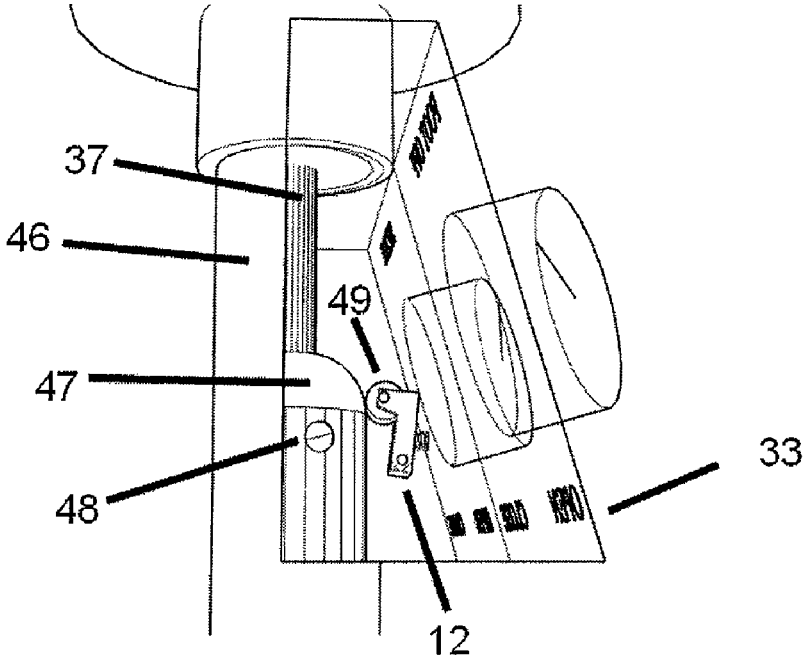
FIG. 10*b* depicts a primary circuitry switch that is contained within the electronics control box when the foot pedal is at-rest.

FIGS. 10*a* and 10*b* illustrate an alternative placement of the primary circuitry switch 12 inside of the electronics control box 33. In this case, the primary circuitry switch 12 is activated by a cam 47 that is connected to a rod 37 that is connected to the foot pedal. In FIG. 10*a*, the pedal has been depressed, rod 37 has moved downward, and the cylindrical cam 47 which has been attached to the rod 37 and secured by set screw 48, moves down with it. The primary circuitry switch 12 gives control to the primary control circuit, wherever it may physically reside. In FIG. 10*b* the pedal is at or near the top of its spring-loaded travel, and the rod 37 and cam 47 have both moved up inside of the high-hat support tube 46. The primary circuitry switch 12 has moved with the cam 47 and transferred control to the secondary control circuit. The drawings show that a huge section of the support tube 46 has been cut away (for illustration purposes), but in reality, only a portion corresponding to the size of the switch cam follower 49 would need to be removed.

There are also instances where a drummer might want a high-hat that has no foot pedal at all, or an instrument with a foot pedal that is removable. As mentioned previously, lots of drummers that play acoustic drums (with an acoustic high-hat) have drum modules for their electronically triggered bass drums. When their foot goes off of the acoustic high-hat to play two bass drum pedals, a footless auxiliary electronic high-hat instrument would be of use. The tilting "sizzle" circuit works so well that high-hat foot pedals may someday become a relic of the past. With this in mind, instruments are presented that have removable foot pedals utilizing a jumper device to bypass the primary (foot pedal) circuit, and in the last embodiments, instruments are introduced that will never use a foot pedal.

Figure 12A:
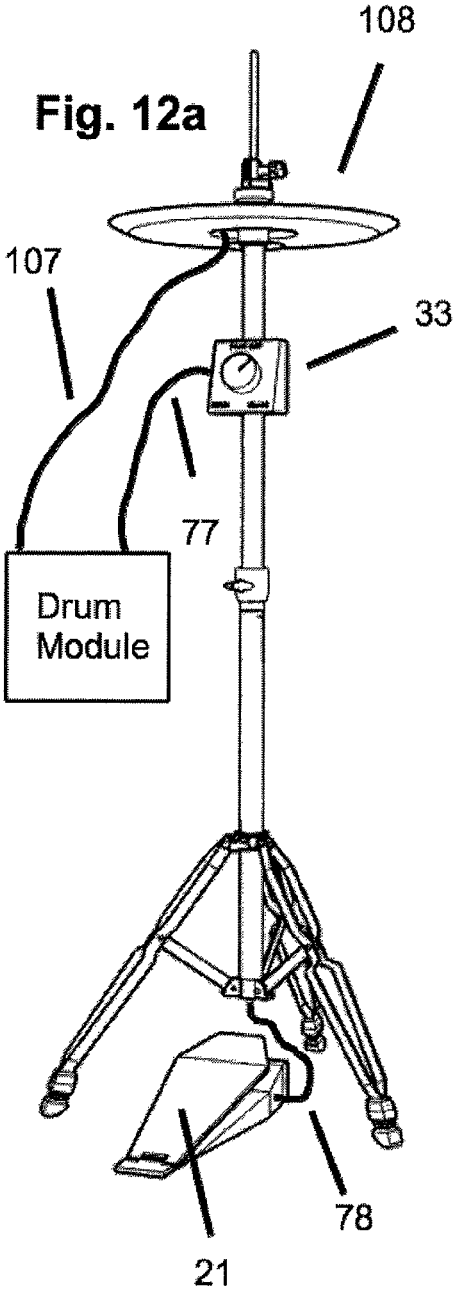
FIG. 12*a* depicts a two circuit high-hat using a foot pedal.

FIG. 12*a* shows a previously disclosed two circuit electronic high hat instrument. The high-hat control connection wire 77 from the module sends out a constant voltage and returns a current that has been modified by the primary (foot pedal) circuit or the secondary (control panel) circuit depending upon the position of the switch in the pedal (as previously discussed). A pedal connection wire 78 goes through the stand and connects to the foot pedal 21. This arrangement is depicted in the wiring diagram in FIG. 11*a*.

Figure 11C:
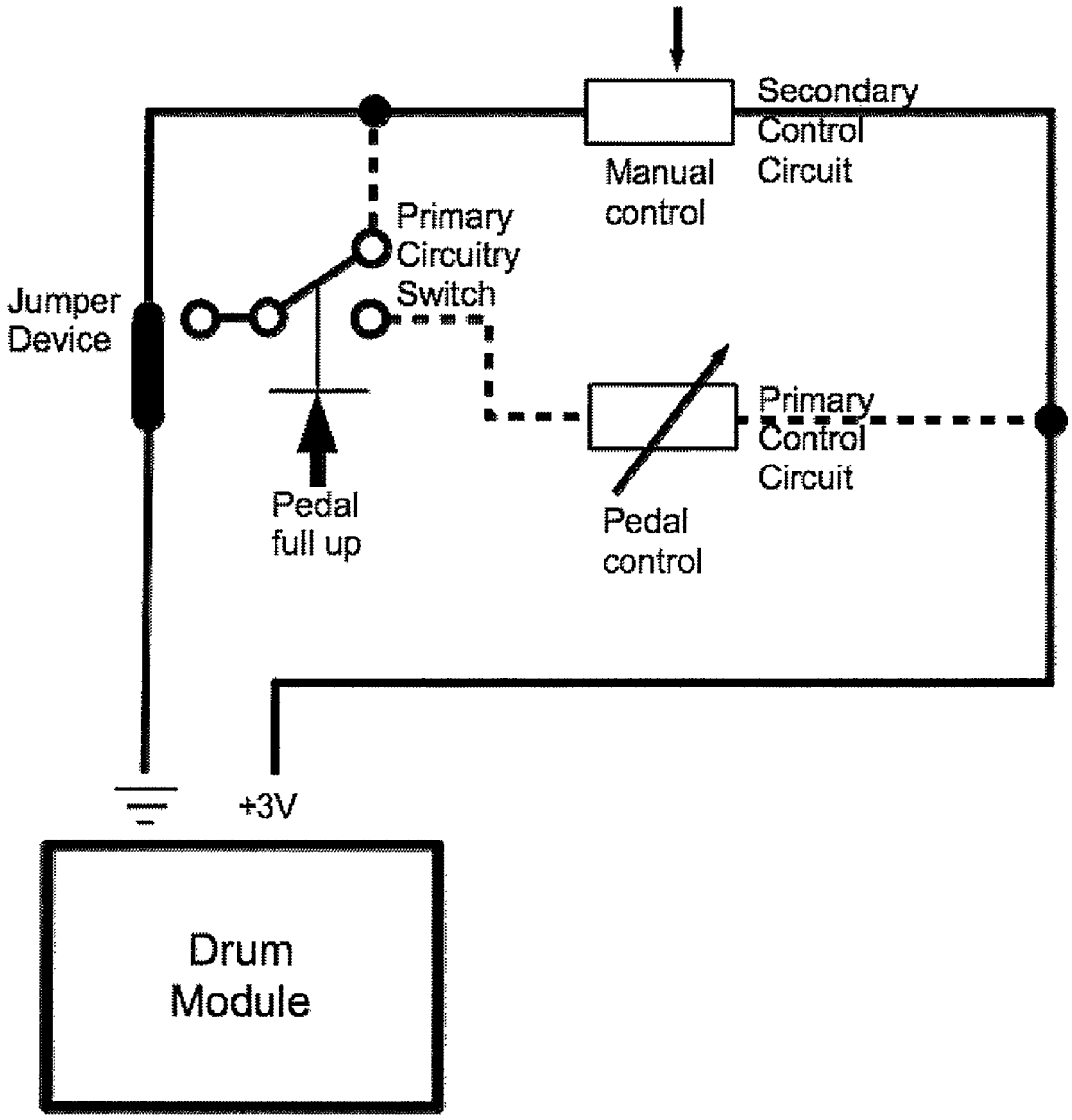
FIG. 11*c* depicts the circuitry logic of an electronic high-hat circuitry system having primary and secondary control circuits using a jumper device.
Figure 12B:
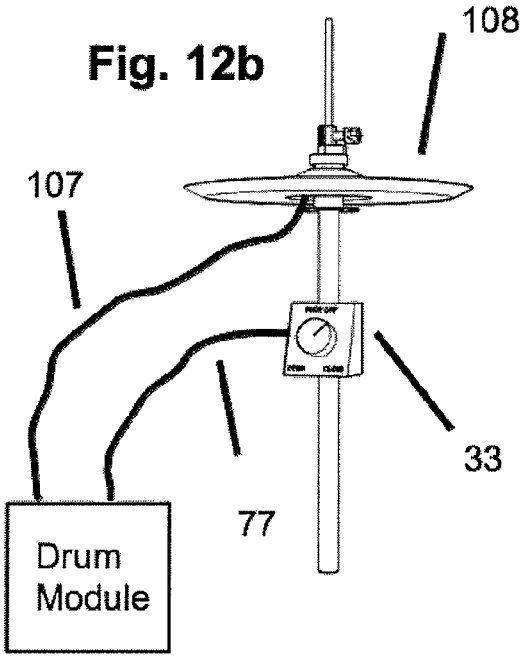
FIG. 12*b* depicts a two circuit high-hat after using a jumper wire to eliminate the pedal.

In the embodiment depicted in FIG. 12*b*, the foot pedal and the connection wire have been eliminated. The circuitry diagram in FIG. 11*c* shows a jumper device that is used to route the control current from the drum module directly to the secondary control circuit, or to a primary circuitry system. When the current is routed to the secondary control circuit, the foot pedal, the primary circuitry switch and the pedal actuated primary control circuit may be removed. In this case (FIG. 12*b*), a jumper wire is used, and it can be inside or outside of a control panel. If the jumper wire is again routed to the primary circuitry switch, the pedal can be restored.

Figure 12C:
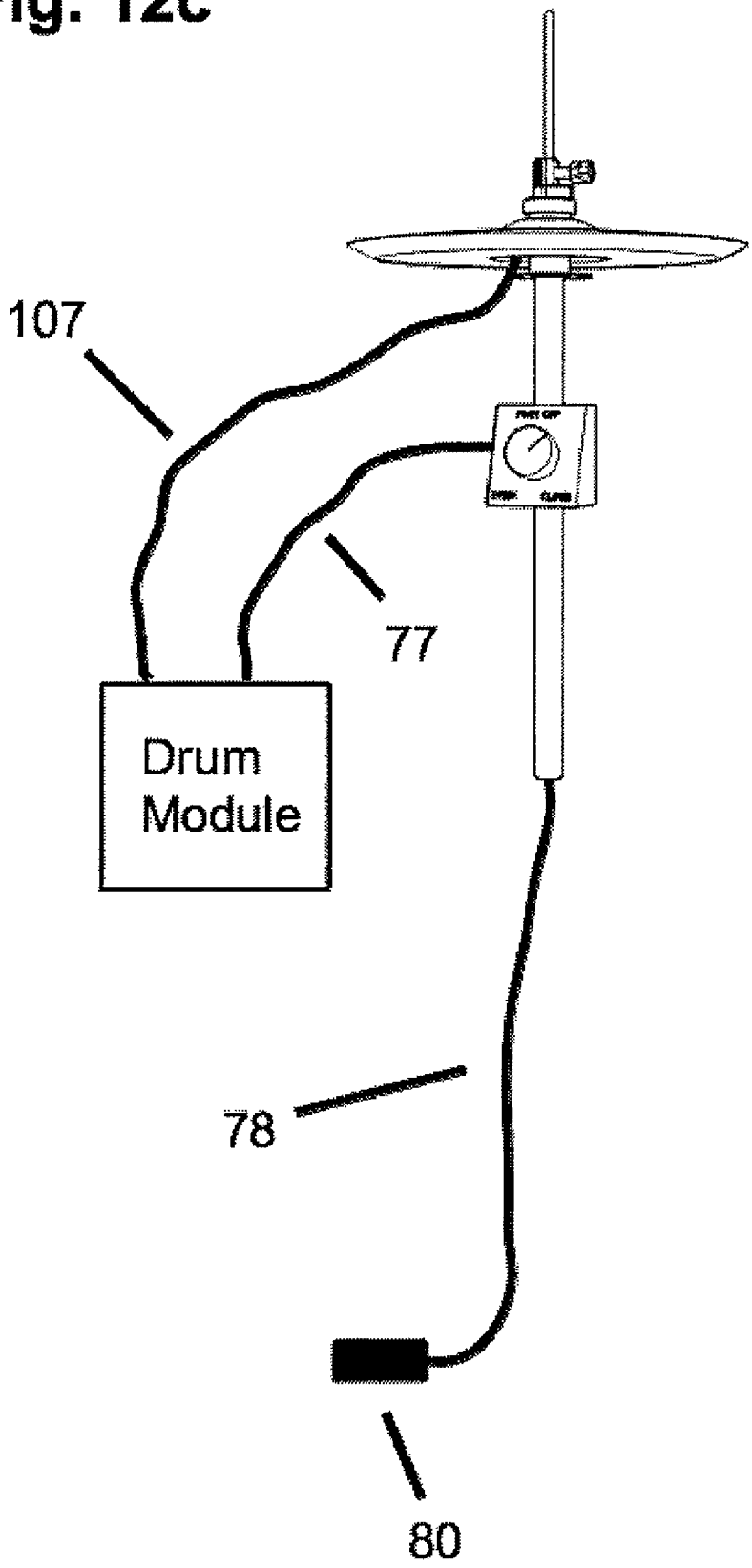
FIG. 12*c* depicts a two circuit high-hat after using a jumper adapter to eliminate the pedal.

In FIG. 12*c*, another kind of jumper device is used to temporarily remove the high-hat pedal. In this embodiment, the pedal connection wire 78 remains even though the pedal has been eliminated, and a jumper adapter 80 now takes the place of the foot pedal. FIG. 11*c* is again illustrative. The control current is routed by a wire inside the jumper adapter as if a high-hat pedal was full up. When the pedal is desired again, the jumper adapter 80 is removed and the pedal connection wire 78 is plugged into a foot pedal.

Figure 11D:
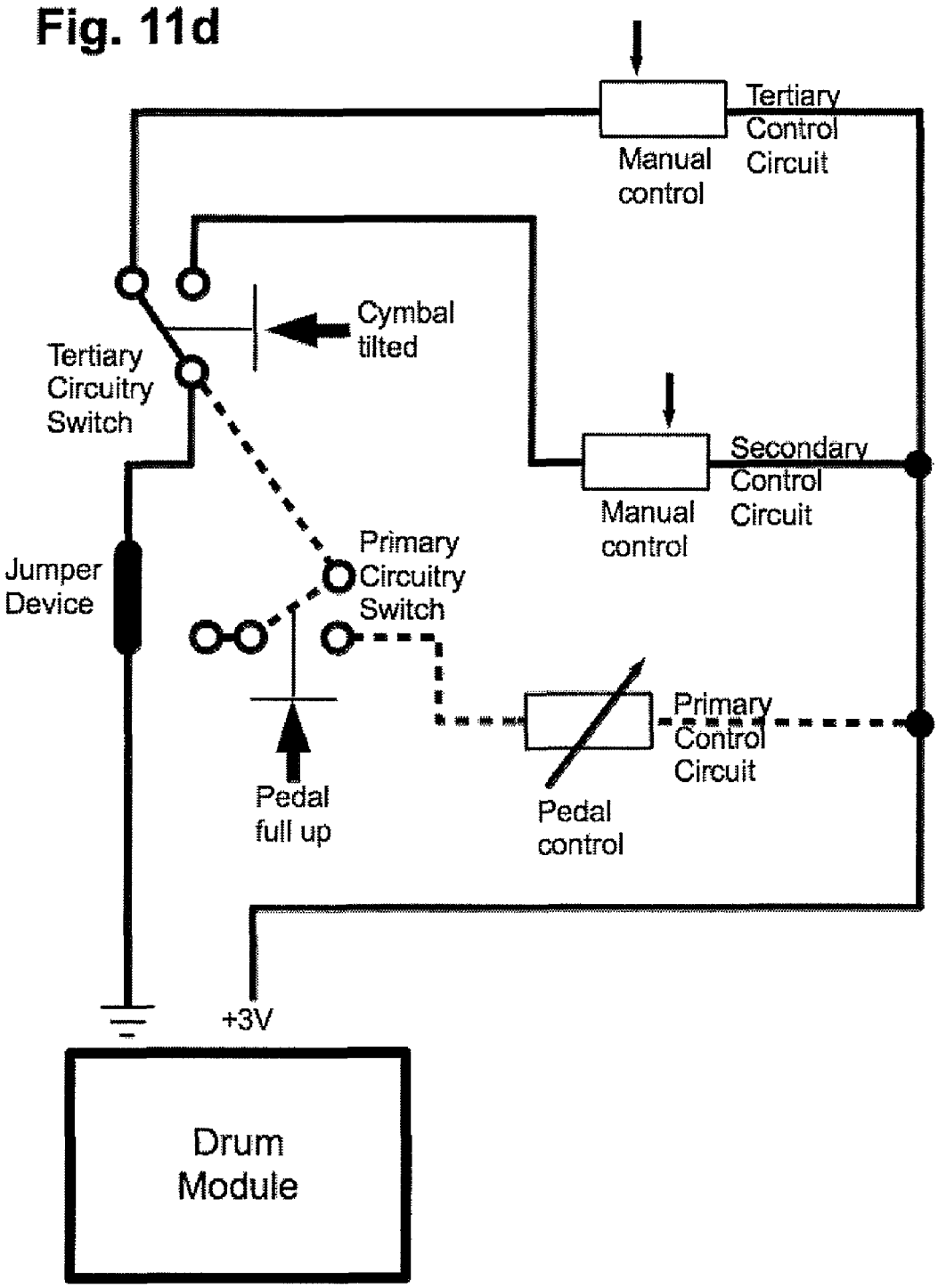
FIG. 11*d* depicts the circuitry logic of an electronic high-hat circuitry system having primary, secondary and tertiary control circuits using a jumper device.
Figure 11E:
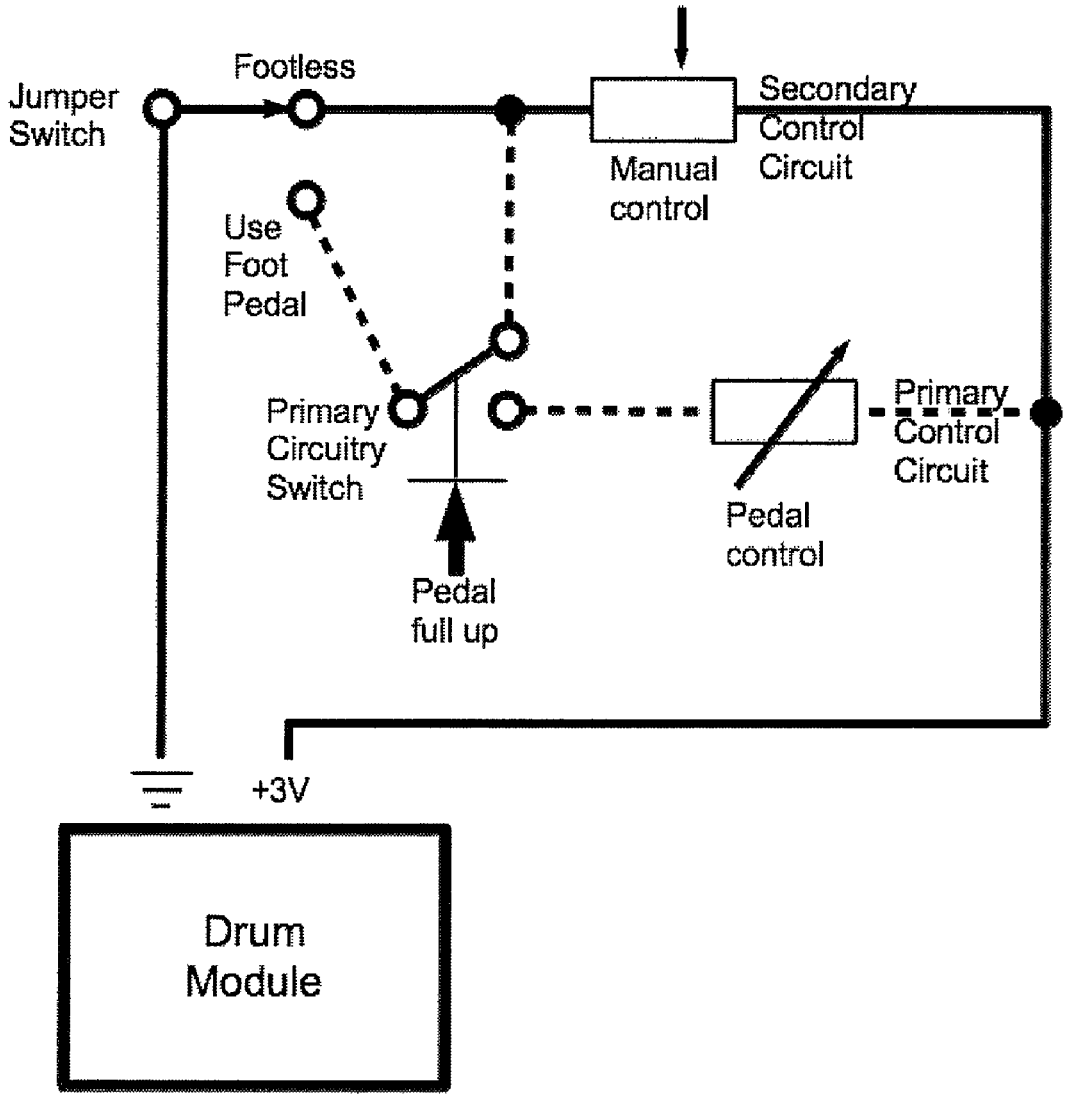
FIG. 11*e* depicts the circuitry logic of an electronic high-hat circuitry system having primary and secondary control circuits using a jumper switch.

In FIG. 11*d*, a three circuit high-hat embodiment has been modified using a jumper device, which can be a wire or a jumper adapter as previously described.

Figure 11F:
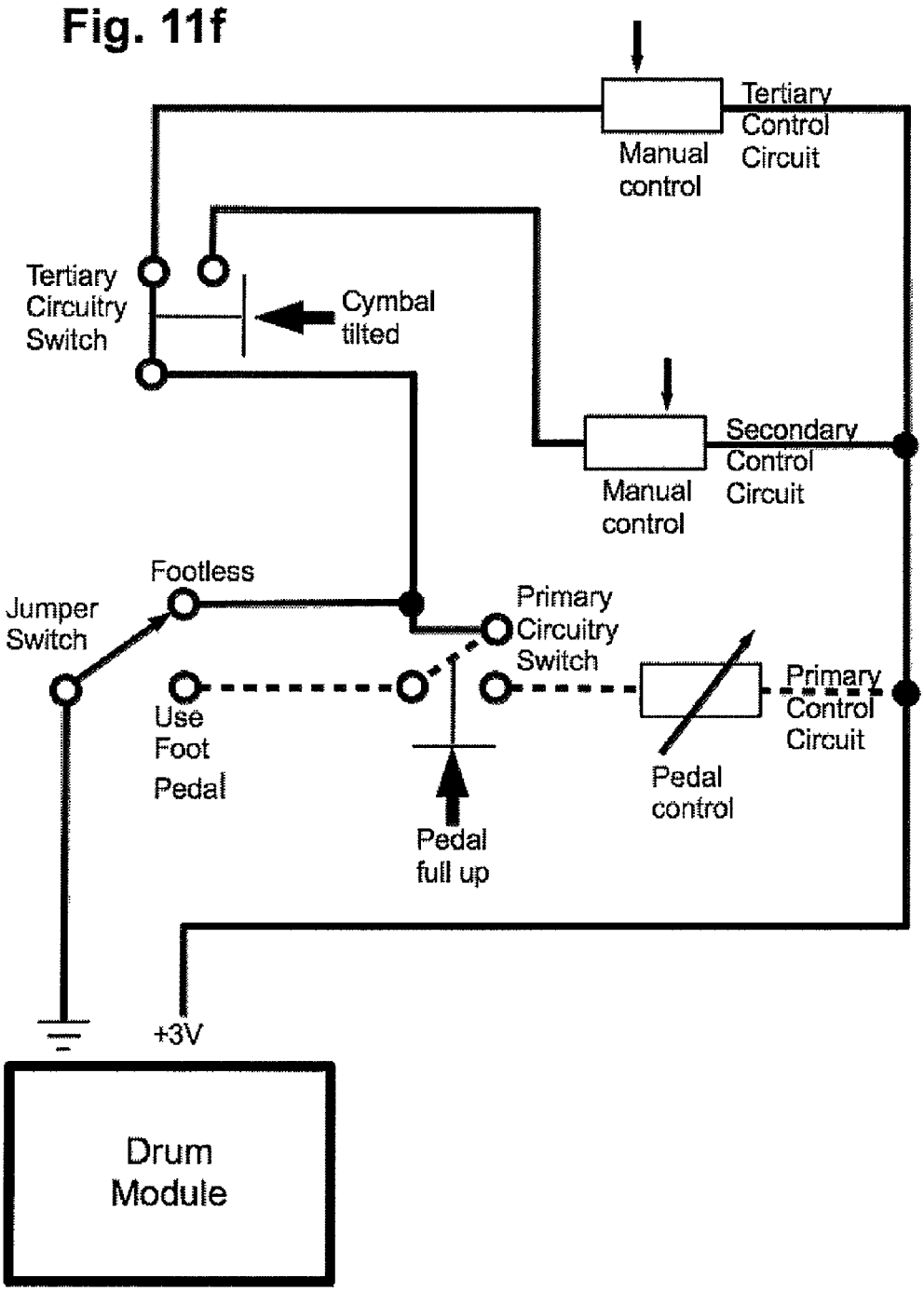
FIG. 11*f* depicts the circuitry logic of an electronic high-hat circuitry system having primary, secondary and tertiary control circuits using a jumper switch.

Another jumper device that can be used in two or three circuit high-hats is a simple switch. In FIG. 12*d*, a three circuit device is shown using a foot pedal. In 12*e*, the pedal connection wire and the foot pedal have been eliminated. A switch 80 under the control panel 33 has been used as a jumper device to route the control current from the drum module directly to the tertiary circuitry switch when the "Footless" position is chosen, as depicted in the electrical diagram in FIG. 11*f*. FIG. 12*f* shows this footless embodiment, ready to be mounted anywhere on a drum set. Only the cymbal trigger wire 107 and the high-hat control wire 77 remain. If a pedal is once again desired, the drummer simply adds a pedal connection wire to the control panel 33, plugs in the pedal and flips the switch 80 to the "Use Footpedal" position. This again directs the module control current to the primary circuitry switch in the foot pedal as previously described.

Figure 11G:
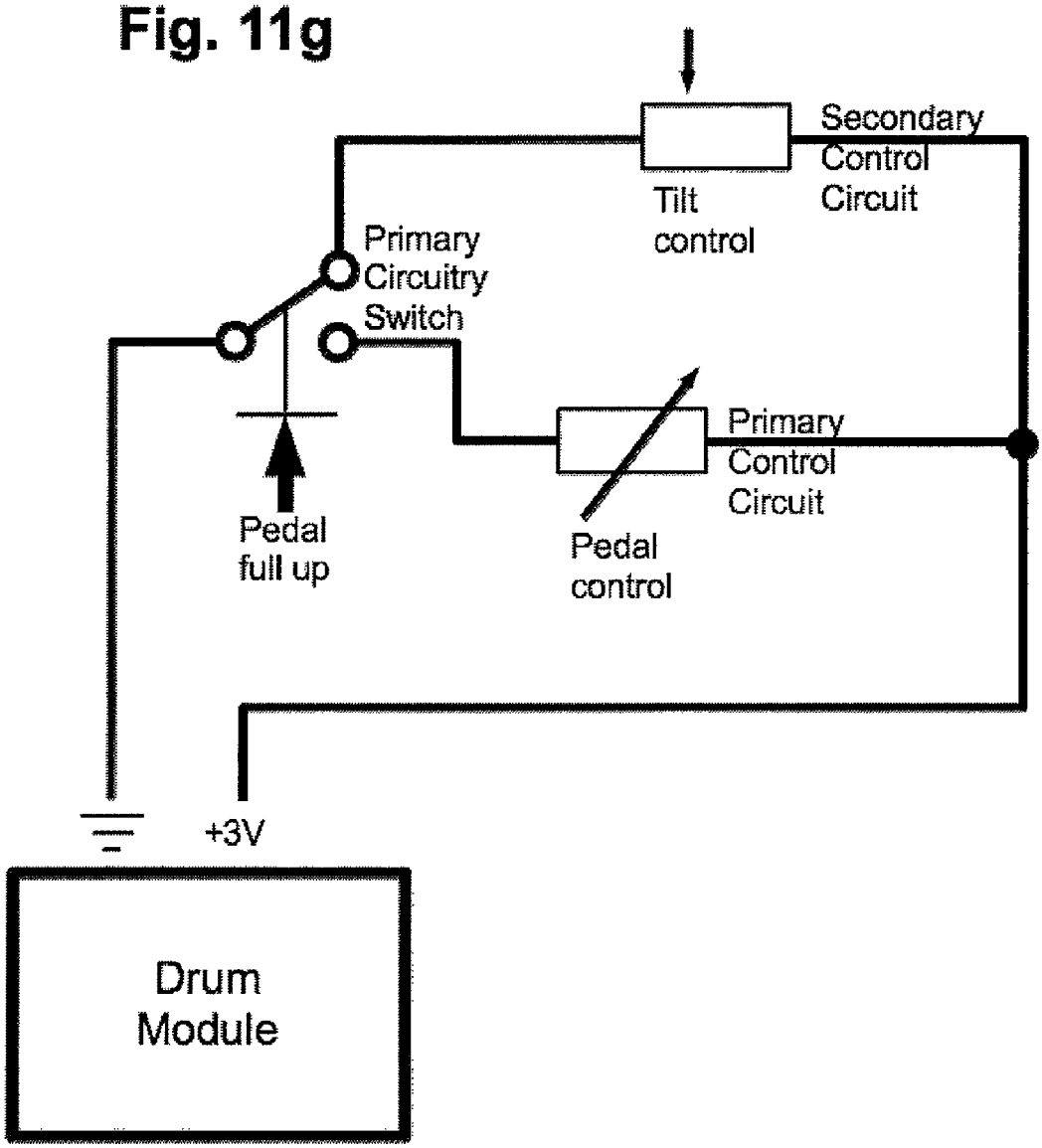
FIG. 11*g* depicts the circuitry logic of an electronic high-hat circuitry system having a primary control circuit and a secondary control circuit utilizing a tilt-actuated potentiometer.
Figure 13A:
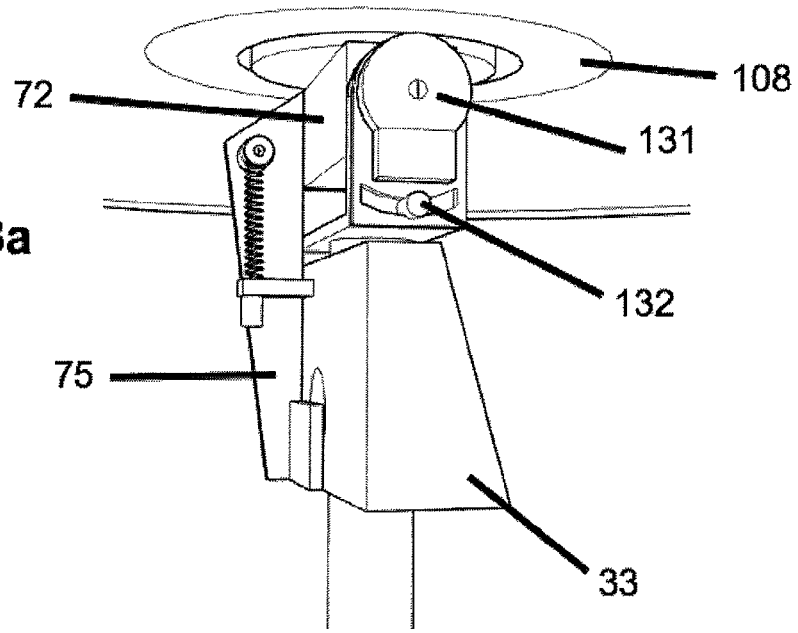
FIG. 13*a* depicts a cymbal mounted on a hub mounted on an axle which turns a potentiometer when the cymbal is tilted.
Figure 13B:
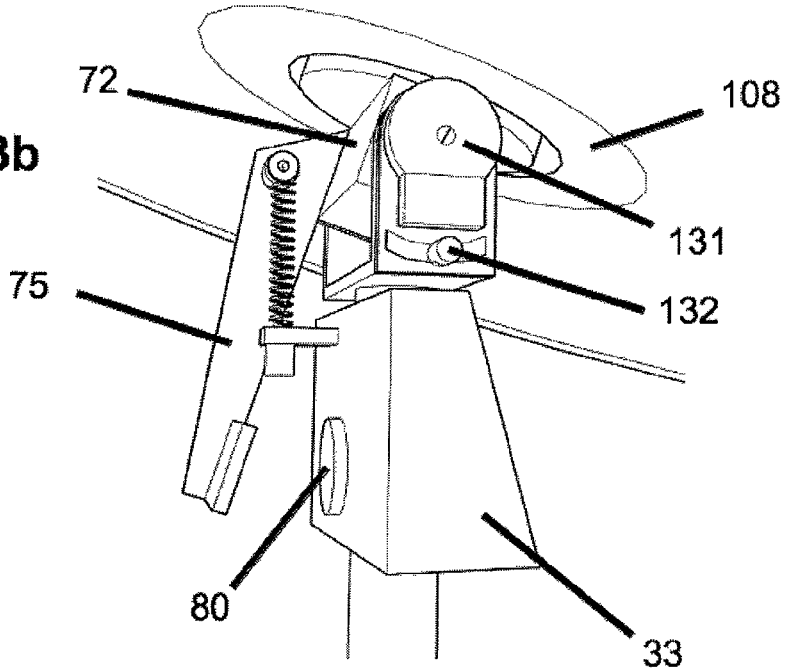
FIG. 13*b* depicts the embodiment of FIG. 13*a* in the tilted position.

A method for achieving the "sizzle" effect is shown in FIGS. 13*a* and 13*b*. The cymbal 108 is mounted on a hub 72 which turns an axle as previously described, but in this case, a potentiometer 131 is also attached to and turns in conjunction with the axle as the cymbal is tilted. The high-hat control voltage runs through said potentiometer 131, and the tonal qualities of the instrument vary as the cymbal is tilted by the drummer, usually by shanking the cymbal with a stick as previously described. The circuit is depicted in FIG. 11*g*. Note that a manual control panel is no longer required, and all of the footless jumper techniques previously described (wire, adapter and switch) will work with this embodiment.

Figure 13C:
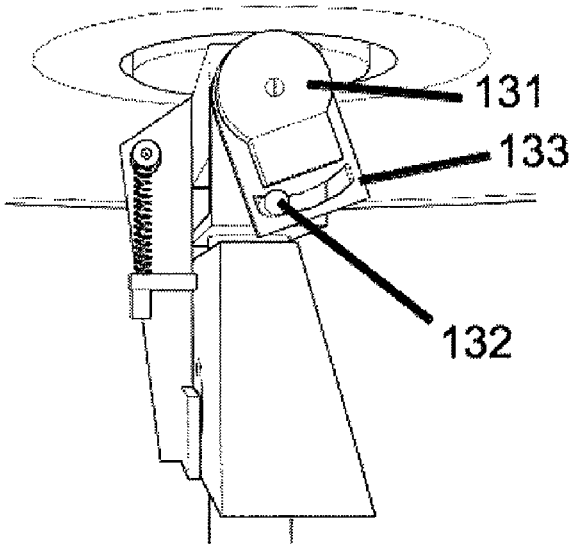
FIGS. 13*c*, 13*d* and 13*e* show how a rotatable potentiometer platform can be used to set the at-rest sound of a high-hat instrument.
Figure 13D:
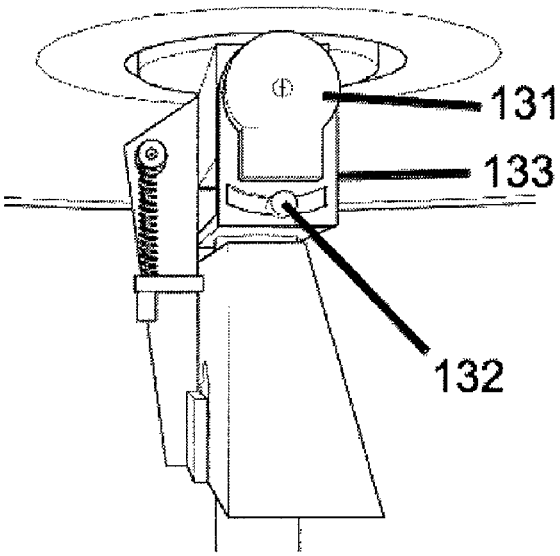
Figure 13E:
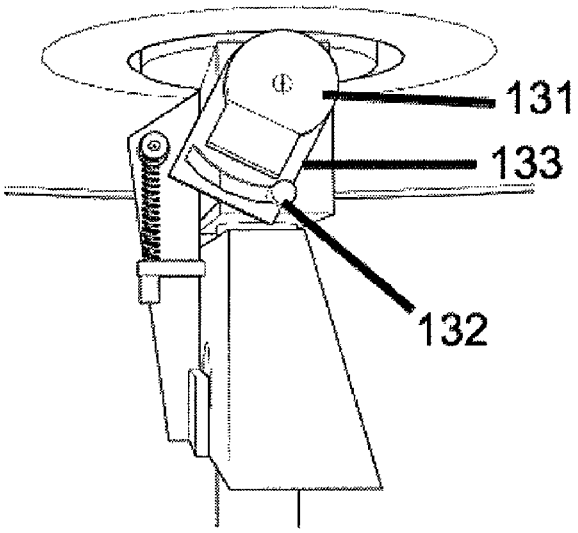

There are times when a drummer will want a full closed high-hat sound when the cymbal is not tilted, and at other times a more open sound may be desired. A simple means of adjusting the at-rest sound quality is presented in FIGS. 13*c*, 13*d*, and 13*e*. In all drawings, the potentiometer 131 is mounted on a platform 133 that is rotatable around the axis on one end and held in place by a set nut 132 on the other. To change the tonal qualities of an at-rest (not tilted) cymbal, the set nut 132 is loosened, the platform 133 and the potentiometer 131 are rotated until the desired sound is achieved, and the set nut 132 is again tightened.

Figure 14:
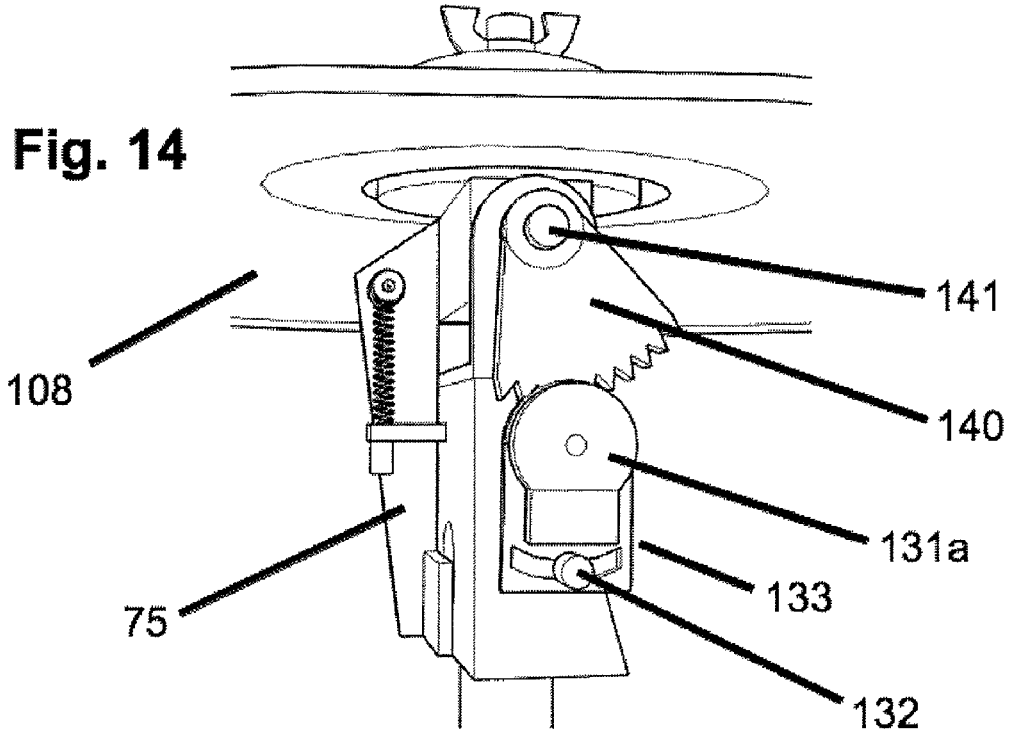
FIG. 14 depicts a high-hat with a drive gear and a geared potentiometer secondary circuit.

There are lots of ways to vary the drum module control current as the cymbal is tilted. In FIG. 14, a drive gear 140 has been attached to the axle 141. As the cymbal 108 is tilted, the drive gear 140 turns the axle of a gear-driven potentiometer 131 a. Note that the at-rest tonal qualities of the device can be set as previously described, using a set nut 132 and a rotating potentiometer platform 133.

Figure 15:
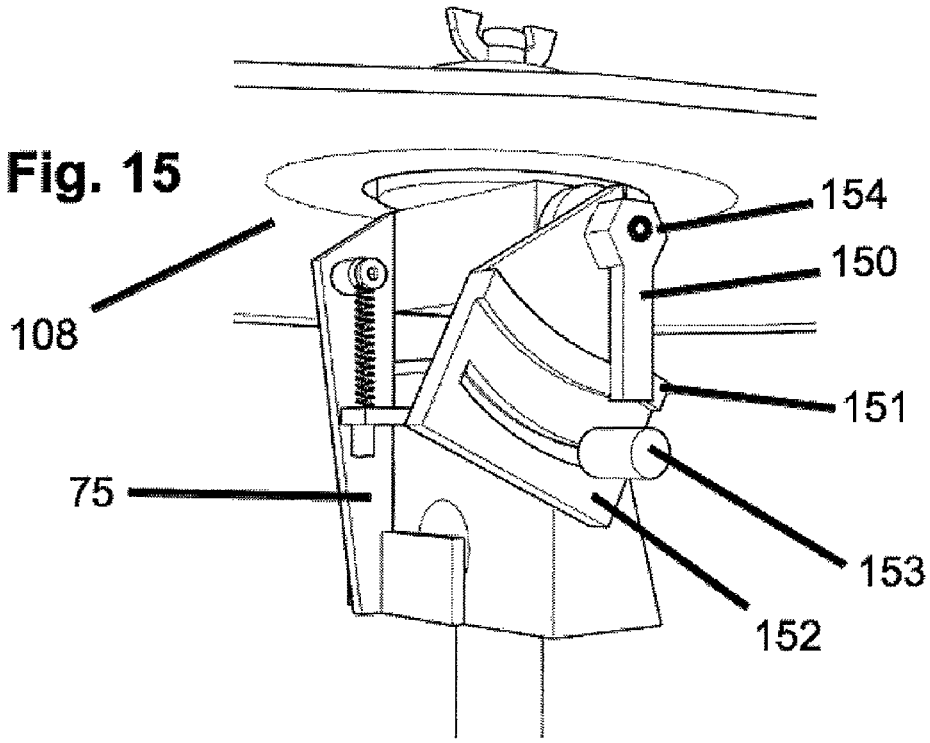
FIG. 15 depicts a high-hat with a wiper arm and resistive material secondary circuit.

In FIG. 15, the high-hat takes the form of a large variable resistor. A wiper arm 150 is attached to the axle 154, and rotates as the cymbal is tilted. The arm is in contact with variable resistive material 151 as it moves in an arc. When the control current from the drum module passes through the wiper and the resistive material, the tonal quality of the high-hat changes as the cymbal is tilted. Note that the resistive material 151 is mounted on a rotating platform 152. This allows for the setting of the at-rest sound using a set nut 153 as previously described.

Figure 11H:
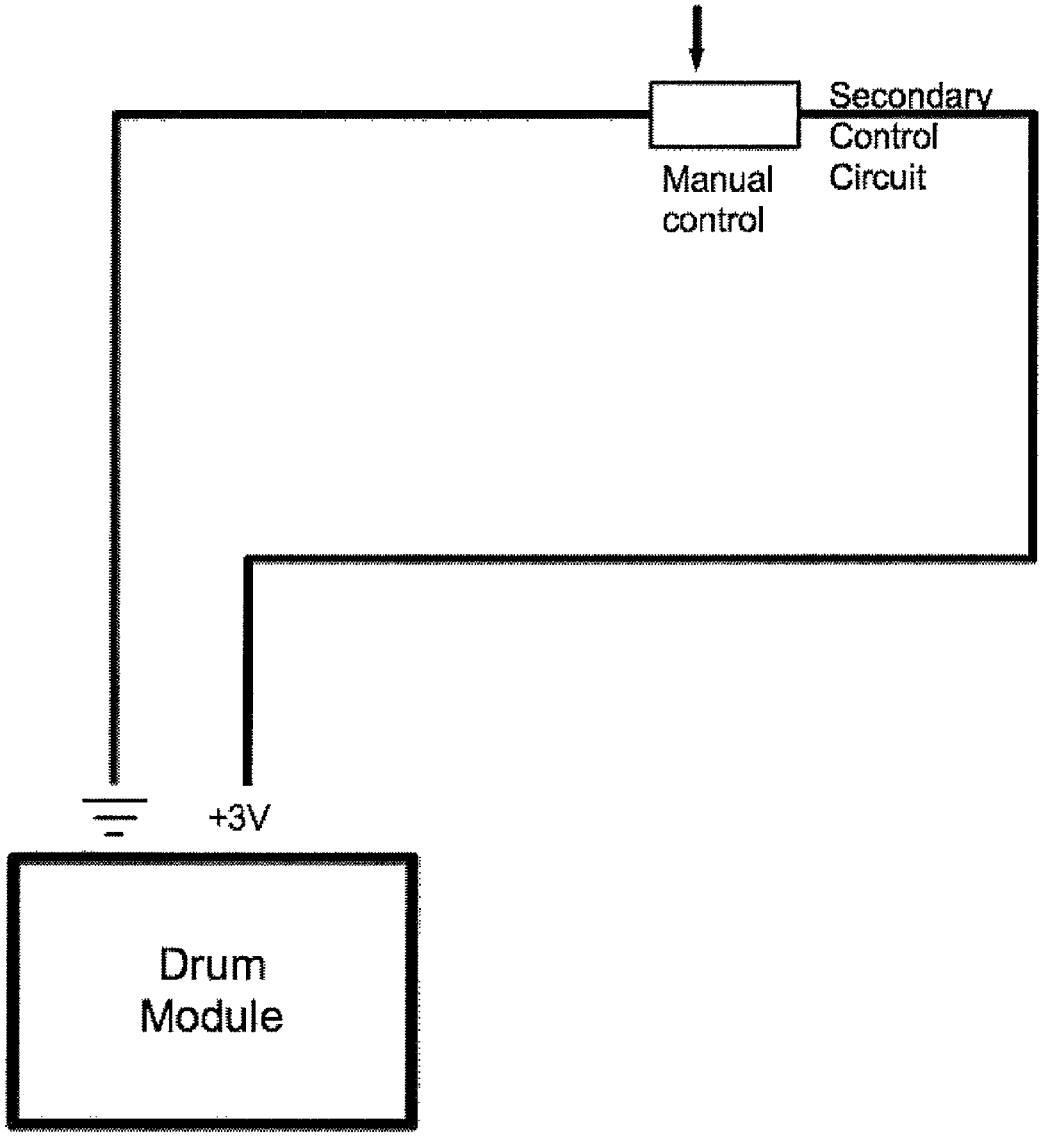
FIG. 11*h* depicts the circuitry logic of an electronic high-hat circuitry system having no foot pedal or primary control circuit, and a secondary control circuit with a manual control.
Figure 11I:
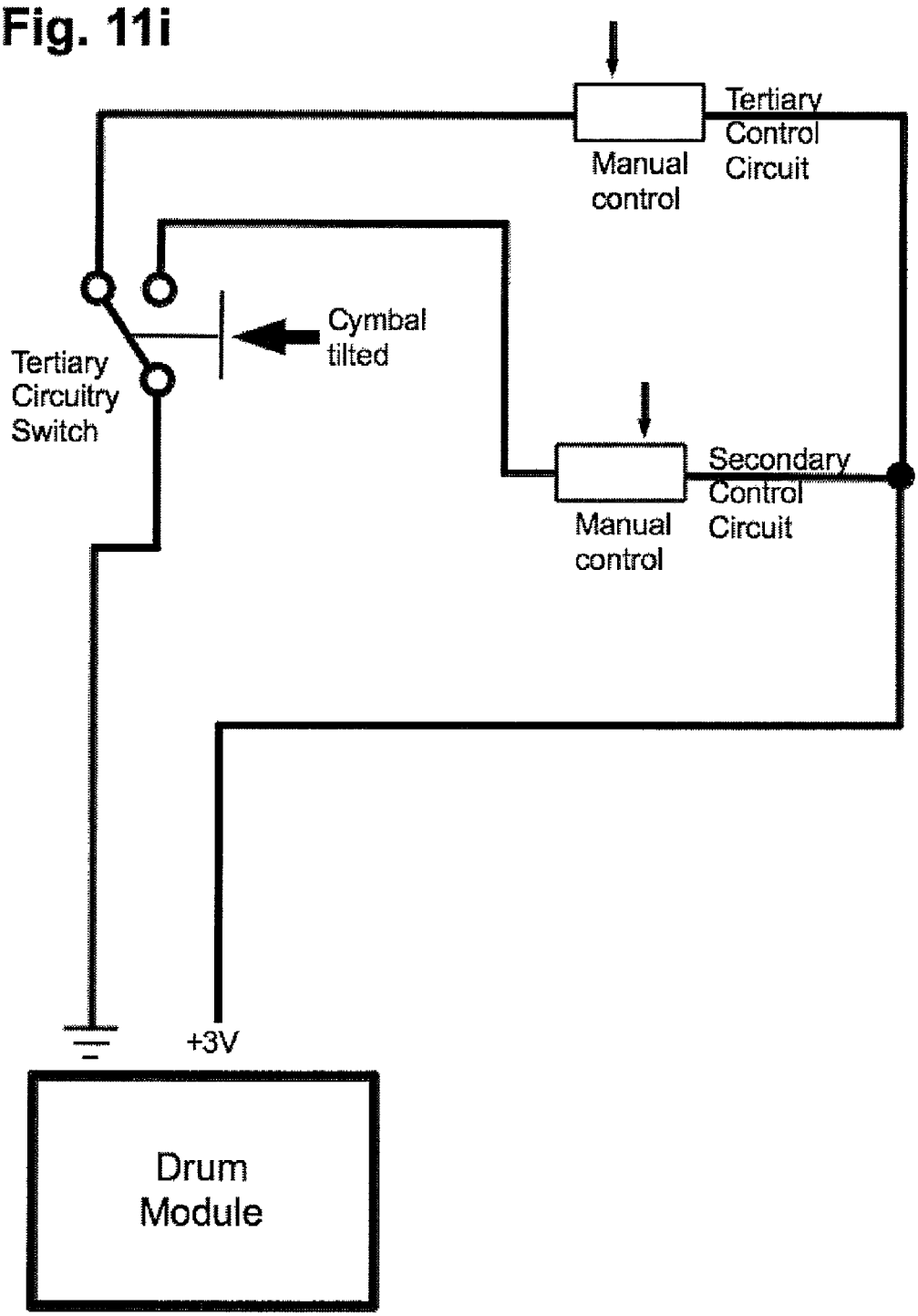
FIG. 11*i* depicts the circuitry logic of an electronic high-hat circuitry system having no foot pedal or primary control circuit, with secondary and tertiary control circuits with manual controls.
Figure 11J:
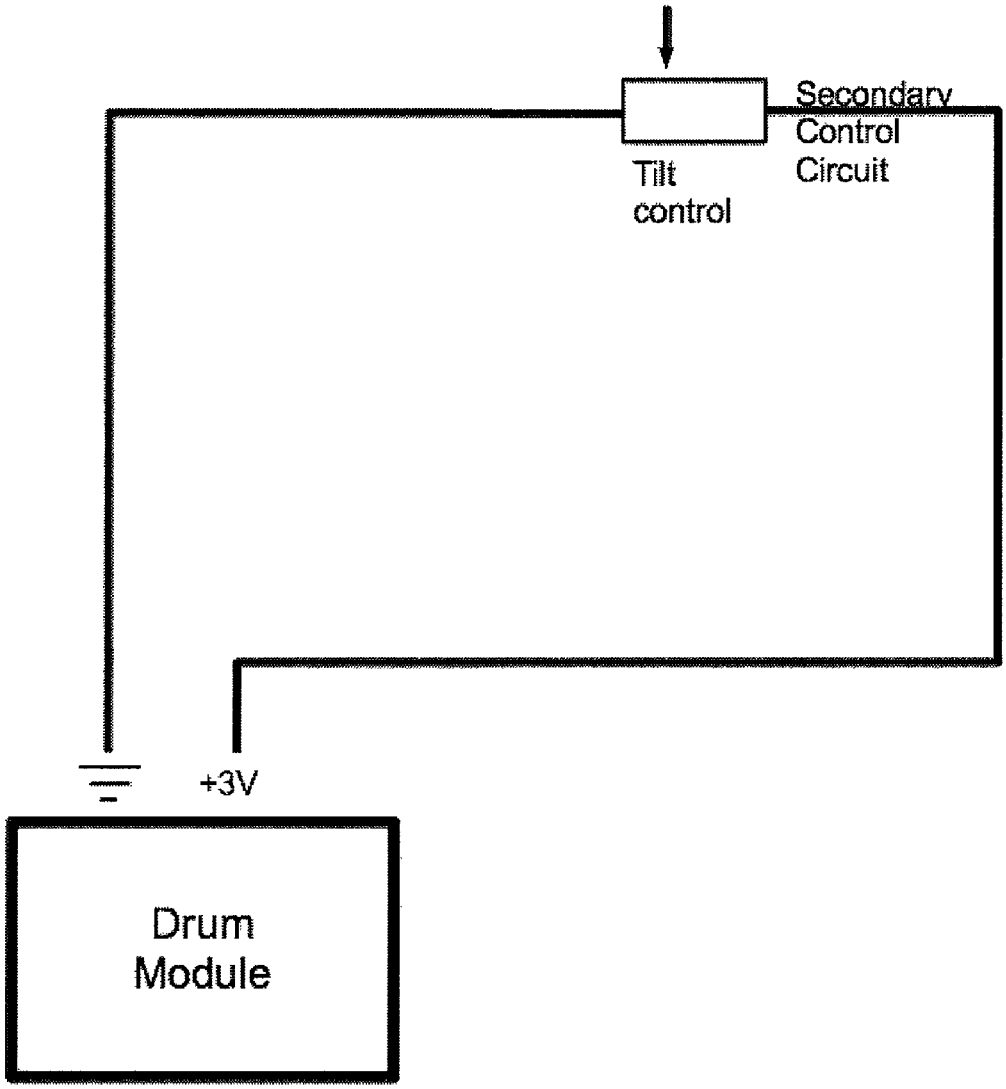
FIG. 11*j* depicts the circuitry logic of an electronic high-hat circuitry system having no foot pedal or primary control circuit, and a secondary control circuit with a potentiometer that varies the control signal in conjunction with cymbal tilt.

Lastly, embodiments are presented that have no foot pedal, without any means to ever have a foot pedal. FIG. 16*a* shows a single circuit high-hat instrument that only has a manually controlled secondary circuit, as depicted in FIG. 11*h*. In FIG. 16*b*, a two circuit tilting high-hat is shown. This device routes the high-hat control current directly to a tertiary circuitry switch as previously described, and the circuit for this instrument is shown in FIG. 11*i*. In FIG. 16*c*, a cymbal is shown with a single secondary control circuit, wherein said circuit varies the control current supplied to said drum module in direct correlation to the degree to which the cymbal has been tilted by the drummer. In this case, a potentiometer is used, but geared or wiper arm instruments are also viable, as previously discussed. The circuitry diagram for this embodiment is shown in FIG. 11*j*.

While all electronic drum modules use the same two inputs (pedal position and cymbal triggering) from the electronic high-hat instrument, the actual configuration may vary. My circuitry system works with all of them. This invention ensures that the high-hat is always a pleasant sounding instrument, wherever the drummer's foot happens to be. Note that there is no distracting effort required on the part of the drummer.

As this invention may be embodied in several forms without departing from the spirit or characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

I claim:

1. An electronic high-hat circuitry system comprising:

an electronic triggering device strikable by a drummer, said electronic triggering device having an at-rest position;

an electronic drum module configured to convert signals from said triggering device into a sound;

a secondary control circuit configured to output a control signal to said drum module, said control signal usable by said drum module to determine a tonal quality of said sound, wherein:

said control signal output by said secondary control circuit is variable by the drummer by tilting said electronic triggering device away from said at-rest position, thereby selecting said tonal quality of said sound.

2. The electronic high-hat circuitry system according to claim 1, wherein said control signal output by said secondary control circuit is variable using a switch, resistors, a potentiometer, or a combination thereof.

3. The electronic high-hat circuitry system according to claim 1 wherein:

said secondary control circuit varies said control signal in direct correlation to a degree of tilt of said electronic triggering device.

4. The electronic high-hat circuitry system according to claim 3, wherein said electronic triggering device is mounted on a hub which is attached to and rotates with an axle, wherein said axle rotation changes a position of a switch, resistors, a potentiometer, or a combination thereof in direct correlation to the degree of tilt of said electronic triggering device.

5. The electronic high-hat circuitry system according to claim 4, wherein a drive gear is attached to said axle which rotates in conjunction with said hub, wherein said drive gear rotation changes a position of said switch, resistors, said potentiometer, or said combination thereof.

6. The electronic high-hat circuitry system according to claim 4, wherein a variable resistor wiper arm is attached to said axle which rotates in conjunction with said hub, said wiper arm being in contact with resistive material as said electronic triggering device is tilted, thereby varying said control signal.

7. The electronic high-hat circuitry system according to claim 1, wherein said tonal quality produced by said secondary control circuit when said electronic triggering device is not tilted is manually set by the drummer.

8. The electronic high-hat circuitry system according to claim 1, further comprising:

a tertiary circuitry switch configured to electrically disable said secondary control circuit, and activate a tertiary control circuit when said electronic triggering device has been tilted, said tertiary circuitry switch disabling said tertiary control circuit and activating said secondary control circuit when said triggering device is not tilted, said tertiary circuit comprising:

a means for manually varying said control signal supplied to said drum module utilizing a switch, resistors, a potentiometer, or a combination thereof;

a control panel comprising a control device operable to manually vary said control signal supplied to said drum module when said tertiary circuit is activated.

9. The electronic high-hat circuitry system according to claim 8, further comprising cymbal platform configured to support said electronic triggering device, said cymbal platform comprising a central support post that enables tilting of said electronic triggering device.

10. The electronic high-hat circuitry system according to claim 9, wherein said cymbal platform includes a tertiary circuitry switch that is activated when said electronic triggering device is tilted.

11. The electronic high-hat circuitry system according to claim 9, further comprising an elastic device configured to tensionably bias said electronic triggering device to said at-rest position.

12. The electronic high-hat circuitry system according to claim 11, further comprising an adjustment device coupled to said elastic device and configured to vary a tension of said elastic device.

13. The electronic high-hat circuitry system according to claim 8, wherein said electronic triggering device is mounted on a hub which rotates on an axle, thereby defining a tilting axis of said electronic triggering device.

14. The electronic high-hat circuitry system according to claim 13, wherein said tertiary circuitry switch is activated when said hub is tilted.

15. The electronic high-hat circuitry system according to claim 13, further comprising an elastic device configured to tensionably bias said electronic triggering device to said at-rest position.

16. The electronic high-hat circuitry system according to claim 15, further comprising an adjustment device coupled to said elastic device and configured to allow adjustment of a force required to tilt said electronic triggering device.

17. The electronic high-hat circuitry system according to claim 1, further comprising a jumper device configured to allow said control signal to be routed from said drum module directly to one of said secondary control circuit or to a primary circuitry system, said primary circuitry system comprising:

a foot pedal which has an at-rest position that is at a top of its travel length;

a primary control circuit which sends electrical signals to said drum module based upon a position of said foot pedal, said signals being used by said drum module to determine said tonal quality of said sound when said foot pedal is not at or near the top of its travel length;

a primary circuitry switch which electrically disables said primary control circuit, and activates said secondary control circuit when said foot pedal is at or near the top of its travel length, and disables said secondary control circuit and activates said primary control circuit when said foot pedal is not at or near the top of its travel length.

18. The electronic high-hat circuitry system according to claim 17, wherein said jumper device comprises a wire or a switch.

19. The electronic high-hat circuitry system according to claim 1, further comprising a jumper device configured to allow said control signal to be routed from said drum module directly to one of a primary circuitry system or a tertiary circuitry system, said tertiary circuitry system comprising:

a tertiary circuitry switch which electrically disables said secondary control circuit, and activates a tertiary control circuit when said primary control circuit is not in use and said electronic triggering device has been tilted, and said tertiary circuitry switch disables said tertiary control circuit and activates said secondary control circuit when said triggering device is not tilted and said primary control circuit is not in use, said tertiary circuit comprising:

a means for manually varying said control signal supplied to said drum module utilizing a switch, resistors, a potentiometer, or a combination thereof;

a control panel comprising a control device operable to manually vary said control signal supplied to said drum module when said tertiary circuit is activated.

20. The electronic high-hat circuitry system according to claim 19, wherein said jumper device comprises a wire or a switch.

* * * * *